US012171384B2

(12) United States Patent
DeJonge et al.

(10) Patent No.: US 12,171,384 B2
(45) **Date of Patent: *Dec. 24, 2024**

(54) SURFACE CLEANING APPARATUS WITH STEAM

(71) Applicant: BISSELL Inc., Grand Rapids, MI (US)

(72) Inventors: Mitchell J. DeJonge, Fruitport, MI (US); Ryan J. Alt, Byron Center, MI (US); Steve M. Johnson, Hudsonville, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/413,137

(22) Filed: Jan. 16, 2024

(65) Prior Publication Data

US 2024/0156320 A1 May 16, 2024

Related U.S. Application Data

(63) Continuation of application No. 18/095,129, filed on Jan. 10, 2023, now Pat. No. 11,910,977.

(60) Provisional application No. 63/297,851, filed on Jan. 10, 2022.

(51) Int. Cl.
*A47L 11/40* (2006.01)
*A47L 11/18* (2006.01)

(52) U.S. Cl.
CPC ..... *A47L 11/4083* (2013.01); *A47L 11/185* (2013.01); *A47L 11/4086* (2013.01); *A47L 11/4088* (2013.01)

(58) Field of Classification Search
CPC ..... A47L 11/4083; A47L 11/185; A47L 11/4086; A47L 11/4088; A47L 11/34; A47L 11/302; A47L 11/225; A47L 13/225; A47L 7/00; A47L 5/00; A47L 9/00; A47L 7/009; A47L 9/02; A47L 5/28; A47L 7/04; A47L 9/18; A47L 9/20; A47L 7/0061; B08B 2230/01; B08B 2203/007; B08B 3/02–028
See application file for complete search history.

(56) References Cited

U.S. PATENT DOCUMENTS

| | | | |
|---|---|---|---|
| 3,491,398 | A | 1/1970 | Segesman |
| 3,559,220 | A | 2/1971 | Thompson et al. |
| 4,498,214 | A | 2/1985 | Oxel |
| 4,733,430 | A | 3/1988 | Westergren |
| 5,493,752 | A | 2/1996 | Crouser et al. |
| 5,613,271 | A | 3/1997 | Thomas |
| 5,860,188 | A | 1/1999 | Maurer et al. |

(Continued)

FOREIGN PATENT DOCUMENTS

| | | | |
|---|---|---|---|
| CN | 105708387 | A | 6/2016 |
| CN | 110338719 | A | 10/2019 |

(Continued)

*Primary Examiner* — Edward F Landrum
*Assistant Examiner* — Sarah Akyaa Fordjour
(74) *Attorney, Agent, or Firm* — Warner Norcross + Judd LLP

(57) ABSTRACT

A surface cleaning apparatus adapted for wet cleaning includes a heated fluid delivery system that dispenses heated liquid and steam vapor. The heated fluid delivery system can include a heated liquid outlet and a steam vapor outlet. The apparatus can further include a liquid delivery system, and/or a recovery system.

19 Claims, 12 Drawing Sheets

(56) References Cited

U.S. PATENT DOCUMENTS

| | | | | |
|---|---|---|---|---|
| 5,958,113 | A | 9/1999 | Collins et al. | |
| 5,983,442 | A | 11/1999 | Louis et al. | |
| 6,393,212 | B1 | 5/2002 | Hutchinson | |
| 6,446,302 | B1 | 9/2002 | Kasper et al. | |
| 6,571,421 | B1 | 6/2003 | Sham et al. | |
| 6,572,711 | B2 | 6/2003 | Sclafani et al. | |
| 6,640,383 | B2 | 11/2003 | Tsen | |
| 6,675,437 | B1 * | 1/2004 | York | F28D 15/00 15/340.1 |
| 6,842,942 | B2 | 1/2005 | Morgan et al. | |
| 6,934,995 | B2 | 8/2005 | Wheeler et al. | |
| 7,048,804 | B2 | 5/2006 | Kisela et al. | |
| 7,137,169 | B2 | 11/2006 | Murphy et al. | |
| 7,146,679 | B2 | 12/2006 | Coates et al. | |
| 7,617,563 | B2 | 11/2009 | Hertrick et al. | |
| 7,640,626 | B2 | 1/2010 | Oh | |
| 7,673,370 | B2 | 3/2010 | Frederick et al. | |
| 7,752,705 | B2 | 7/2010 | McDowell et al. | |
| 7,937,801 | B2 | 5/2011 | Egler et al. | |
| 8,056,181 | B2 | 11/2011 | Kim et al. | |
| 8,087,123 | B2 | 1/2012 | Merz | |
| 8,528,161 | B2 | 9/2013 | Vrdoljak et al. | |
| 8,549,697 | B1 | 10/2013 | Moyher, Jr. et al. | |
| 8,627,543 | B2 | 1/2014 | Vrdoljak et al. | |
| 8,695,159 | B2 | 4/2014 | Van Der Kooi et al. | |
| 8,752,236 | B2 | 6/2014 | Oh et al. | |
| 9,155,440 | B2 | 10/2015 | Nuttall et al. | |
| 9,173,536 | B2 | 11/2015 | Van Der Kooi et al. | |
| 9,265,394 | B2 | 2/2016 | Van Der Kooi et al. | |
| 9,351,618 | B2 | 5/2016 | Van Der Kooi et al. | |
| 9,351,623 | B2 | 5/2016 | Carter | |
| 9,414,728 | B2 | 8/2016 | Van Der Kooi et al. | |
| 9,968,231 | B2 | 5/2018 | Bassett et al. | |
| 9,968,235 | B2 | 5/2018 | Vail et al. | |
| 9,999,332 | B2 | 6/2018 | Braendle et al. | |
| 10,130,230 | B2 | 11/2018 | Moser et al. | |
| 10,130,237 | B2 | 11/2018 | Innes et al. | |
| 10,188,252 | B2 | 1/2019 | Nguyen et al. | |
| 10,349,797 | B2 | 7/2019 | Moser et al. | |
| 10,376,124 | B2 | 8/2019 | McDowell et al. | |
| 10,413,143 | B2 | 9/2019 | Van Der Kooi et al. | |
| 10,448,800 | B2 | 10/2019 | Weeks et al. | |
| 10,602,903 | B2 | 3/2020 | Johnson et al. | |
| 10,694,914 | B2 | 6/2020 | McGee | |
| 10,856,715 | B2 | 12/2020 | Van Der Kooi et al. | |
| 10,881,258 | B2 | 1/2021 | Moser et al. | |
| 10,932,644 | B2 | 3/2021 | Vrdoljak et al. | |
| 10,959,590 | B2 | 3/2021 | Moser et al. | |
| 11,045,062 | B2 | 6/2021 | Innes et al. | |
| 11,723,506 | B2 * | 8/2023 | Bian | A47L 11/4088 15/320 |
| 2002/0042965 | A1 | 4/2002 | Salem et al. | |
| 2002/0112744 | A1 | 8/2002 | Besseling | |
| 2002/0170137 | A1 | 11/2002 | Coates et al. | |
| 2003/0051306 | A1 | 3/2003 | Morgan et al. | |
| 2003/0051308 | A1 | 3/2003 | Morgan et al. | |
| 2003/0051309 | A1 | 3/2003 | Morgan et al. | |
| 2003/0051310 | A1 | 3/2003 | Morgan et al. | |
| 2003/0217762 | A1 * | 11/2003 | Kobayashi | B08B 7/00 134/2 |
| 2003/0226230 | A1 | 12/2003 | Hertrick et al. | |
| 2004/0111822 | A1 | 6/2004 | Syu | |
| 2004/0134016 | A1 | 7/2004 | Kisela et al. | |
| 2004/0221415 | A1 | 11/2004 | Tondra et al. | |
| 2005/0076467 | A1 | 4/2005 | Stephens et al. | |
| 2005/0091782 | A1 | 5/2005 | Gordon et al. | |
| 2005/0132523 | A1 | 6/2005 | Kegg et al. | |
| 2005/0144751 | A1 | 7/2005 | Kegg et al. | |
| 2005/0223897 | A1 | 10/2005 | Ponjican et al. | |
| 2005/0283936 | A1 | 12/2005 | Barker et al. | |
| 2006/0123581 | A1 | 6/2006 | O'Neal | |
| 2006/0123584 | A1 | 6/2006 | O'Neal | |
| 2006/0123587 | A1 | 6/2006 | Parr et al. | |
| 2007/0186370 | A1 | 8/2007 | Oh et al. | |
| 2008/0301900 | A1 | 12/2008 | Choi et al. | |
| 2009/0165822 | A1 | 7/2009 | Kinitz et al. | |
| 2012/0047677 | A1 | 3/2012 | Paliobeis et al. | |
| 2012/0047680 | A1 | 3/2012 | Chaney | |
| 2012/0066858 | A1 | 3/2012 | Krondorfer et al. | |
| 2012/0066859 | A1 | 3/2012 | Louis et al. | |
| 2012/0066861 | A1 | 3/2012 | Louis et al. | |
| 2013/0091652 | A1 | 4/2013 | Henderson et al. | |
| 2013/0111693 | A1 | 5/2013 | Krondorfer et al. | |
| 2014/0053363 | A1 | 2/2014 | Barlotti et al. | |
| 2014/0208536 | A1 | 7/2014 | Ni | |
| 2014/0215749 | A1 | 8/2014 | Van Der Kooi et al. | |
| 2014/0259514 | A1 | 9/2014 | Vail et al. | |
| 2016/0345795 | A1 | 12/2016 | Manning | |
| 2017/0119225 | A1 * | 5/2017 | Xia | A47L 11/302 |
| 2017/0127900 | A1 | 5/2017 | Wright et al. | |
| 2017/0251897 | A1 * | 9/2017 | McDowell | A47L 11/4088 |
| 2019/0082906 | A1 * | 3/2019 | Conrad | B01D 29/35 |
| 2019/0183300 | A1 | 6/2019 | Yuen et al. | |
| 2019/0183311 | A1 | 6/2019 | Diana et al. | |
| 2020/0022550 | A1 | 1/2020 | Amoretti | |
| 2020/0046196 | A1 | 2/2020 | Weeks et al. | |
| 2020/0205636 | A1 | 7/2020 | Johnson et al. | |
| 2020/0214526 | A1 | 7/2020 | Huang et al. | |
| 2021/0169294 | A1 | 6/2021 | Pruiett et al. | |

FOREIGN PATENT DOCUMENTS

| | | | |
|---|---|---|---|
| CN | 110353560 | A | 10/2019 |
| DE | 202015009606 | U1 | 7/2018 |
| DE | 102017120736 | A1 | 3/2019 |
| EP | 1132037 | A2 | 9/2001 |
| EP | 1603446 | B1 | 6/2010 |
| EP | 2229865 | B1 | 6/2012 |
| EP | 2835088 | A1 | 2/2015 |
| EP | 2521477 | B1 | 10/2015 |
| EP | 3203893 | B1 | 6/2020 |
| EP | 3016565 | B1 | 7/2020 |
| EP | 3750460 | A1 | 12/2020 |
| EP | 3628204 | B1 | 2/2021 |
| EP | 3016566 | B1 | 12/2022 |
| FR | 2661339 | A1 | 10/1991 |
| GB | 2545725 | A | 6/2017 |
| GB | 2588436 | A | 4/2021 |
| KR | 20060032128 | A | 4/2006 |
| WO | 2008096950 | A1 | 8/2008 |
| WO | 13055364 | A1 | 4/2013 |
| WO | 16087812 | A1 | 6/2016 |
| WO | 2016191624 | A1 | 12/2016 |
| WO | 2019048496 | A1 | 3/2019 |
| WO | 2020048851 | A1 | 3/2020 |
| WO | 20198211 | A1 | 10/2020 |
| WO | 21130103 | A1 | 7/2021 |
| WO | 21130332 | A1 | 7/2021 |

* cited by examiner

SURFACE CLEANING APPARATUS WITH STEAM

CROSS-REFERENCE TO RELATED APPLICATION(S)

This application is a continuation of U.S. patent application Ser. No. 18/095,129, filed Jan. 10, 2023, which claims the benefit of U.S. Provisional Patent Application No. 63/297,851, filed Jan. 10, 2022, both of which are incorporated herein by reference in their entirety.

BACKGROUND

Several different categories of apparatuses are known for "wet" cleaning surfaces. One category includes extraction cleaners for deep cleaning carpets and other fabric surfaces, such as upholstery. Extraction cleaners have a liquid delivery system and a liquid recovery system. The liquid delivery system typically includes a supply tank for storing a supply of cleaning liquid, a distributor for applying the cleaning liquid to the surface to be cleaned, and a liquid supply conduit for delivering the cleaning liquid from the supply tank to the distributor. The liquid recovery system usually comprises a recovery tank, a nozzle adjacent the surface to be cleaned and in fluid communication with the recovery tank through a working air conduit, and a source of suction in fluid communication with the working air conduit to draw the cleaning liquid from the surface to be cleaned and through the nozzle and the working air conduit to the recovery tank. Extraction cleaners sometimes incorporate an in-line heater can heat the cleaning liquid to a temperature less than boiling. While extraction cleaners are effective, standard extraction cleaners may not treat all stain types are treated equally well.

Another category of "wet" cleaning apparatuses includes steam mops that are typically configured for cleaning hard surfaces, such as bare flooring, including tile, hardwood, laminate, vinyl, and linoleum, as well as countertops, stove tops and the like. Typically, steam mops comprise at least one liquid supply tank for storing water that is fluidly connected to a selectively engageable pump or valve. The outlet of the pump or valve is fluidly connected to a steam generator, which comprises a heating element for heating the liquid. The steam generator produces steam, which can be directed towards the surface to be cleaned through a steam distributor. Steam is typically applied to the backside of a cleaning pad that is attached to the apparatus. Steam eventually saturates the cleaning pad and the damp pad is wiped across the surface to be cleaned to remove debris present on the surface. One drawback to these steam apparatus is that they are typically not suitable for soft surfaces.

Another drawback with both extraction and steam cleaners is that it can be difficult for a user to ascertain whether the apparatus is operating correctly to dispense fluid (i.e. liquid or steam as the case may be), as the distributor is generally hidden from view. While is some cases the user can monitor the liquid level within the supply tank during use to make an inference about whether there is liquid available to be apparatus, the position of the supply tank, the user's viewing perspective relative to the tank, and/or the opacity of the tank may hinder the user's ability to visually ascertain the liquid level within the supply tank.

BRIEF SUMMARY

A surface cleaning apparatus with improved wet cleaning capabilities is provided herein to improve user experience and cleaning efficacy. The apparatus includes a heated fluid delivery system that dispenses heated liquid and steam vapor. Aspects of the disclosure relate to an improved surface cleaning apparatus with heated liquid and steam dispensing, as well as unheated liquid delivery and liquid recovery.

According to one aspect of the disclosure, a surface cleaning apparatus includes a housing having a portion adapted for movement over a surface to be cleaned and fluid delivery system that includes a fluid supply container configured to store a supply of a cleaning fluid, a heater in fluid communication with the fluid supply container, a heated fluid inlet in fluid communication with the heater to receive heated fluid from the heater, a heated liquid outlet to dispense the liquid phase of the heated fluid to the surface to be cleaned as heated liquid, and a steam vapor outlet to dispense the vapor phase of the heated fluid as steam vapor, and one or more of an outlet diameter of the heated liquid outlet of approximately 0.5 mm, the heated liquid outlet is disposed about 20 mm from an underside of the portion of the housing adapted for movement over a surface to be cleaned, and the steam vapor outlet is disposed about 9.75 mm from an underside of the portion of the housing adapted for movement over a surface to be cleaned.

The heated liquid outlet can dispense heated liquid at a flow rate of 41 to 72 ml/min and the steam vapor outlet can dispense steam vapor at a flow rate of 10 to 18 ml/min.

The heated liquid outlet and the steam vapor outlet can dispense heated liquid at temperature of about 90 to 100° C.

The heater can generate heated fluid having a steam quality of 20 to 30%. The surface cleaning apparatus can include a liquid delivery system comprising a liquid dispenser having an unheated liquid outlet to dispense cleaning fluid to the surface to be cleaned as unheated liquid.

The outlet diameter of the unheated liquid outlet can be approximately 0.8 to 1.0 mm and/or the unheated liquid outlet can be disposed about 20 to 25 mm from an underside of the portion of the housing adapted for movement over a surface to be cleaned.

The unheated liquid outlet can dispense unheated liquid at a flow rate of 1600 to 2100 ml/min.

The unheated liquid outlet can dispense unheated liquid at a temperature of 32-55° C.

The surface cleaning apparatus can include a fluid recovery system including a suction nozzle, a recovery container, and a suction source. At least the steam vapor outlet is located on an exterior of the suction nozzle.

According to another aspect of the disclosure, methods for operating the surface cleaning apparatus are provided.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION

Figure 1:
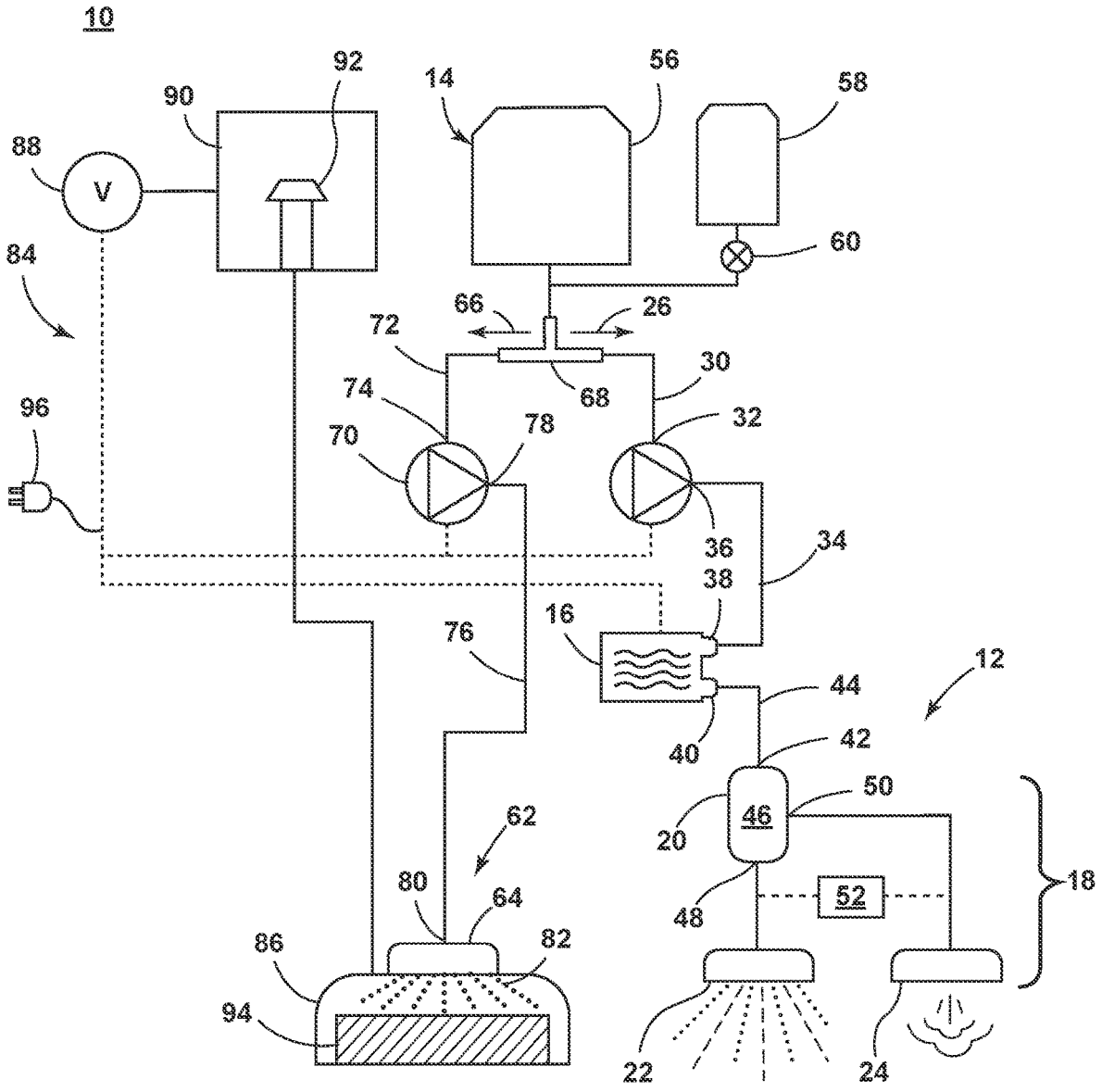
FIG. 1 is a schematic view of a surface cleaning apparatus in the form of an extraction cleaner.

The present disclosure generally relates to a surface cleaning apparatus adapted for wet cleaning and can include a heated fluid delivery system, a liquid delivery system, and/or a recovery system. Aspects of the disclosure relate to an improved surface cleaning apparatus with heated liquid and steam dispensing. According to one aspect of the disclosure, a surface cleaning apparatus is provided with a dual-phase distributor that dispenses heated liquid and steam vapor.

As used herein, the term "dirt" includes dirt, soil, dust, hair, stains, and other debris, unless otherwise noted.

As used herein, the term "cleaning fluid" may encompass liquid, steam, or a mixture of both liquid and steam.

As used herein, the term "heated fluid" includes liquid, steam, or a mixture of both liquid and steam heated to around 100±10° C., alternately about 90 to 100° C., alternatively about 95 to 98° C. The heated fluid may be produced by heating a cleaning fluid with a heat source on board the surface cleaning apparatus. The heated fluid can include at least some liquid and at least some steam, e.g. a liquid phase and a vapor phase. For example, the heated fluid can have a steam quality of around 20 to 30%, alternately about 24%. As used herein, "steam quality" is the proportion of saturated steam in a saturated condensate (liquid) and steam mixture. For example, saturated steam vapor has a steam quality of 100%, and saturated liquid has a steam quality of 0%.

As used herein, the term "heated liquid" includes a liquid, such as but not limited to water or solutions containing water (like water mixed with a cleaning chemistry, fragrance, etc.), heated to around 100±10° C., alternately about 90 to 100° C., alternatively about 95 to 98° C. The heated liquid can include at least some steam, or substantially not steam. For example, the heated liquid can have a steam quality of around 20 to 30%, alternately about 24%. In other examples, the heated liquid can have a steam quality below 20%, including a steam quality near or at 0%.

As used herein, the term "unheated liquid" includes a liquid, such as but not limited to water or solutions containing water (like water mixed with a cleaning chemistry, fragrance, etc.), below the temperature of heated liquid, including but not limited to 32 to 55° C. The unheated liquid may or may not be heated by a heat source on board the surface cleaning apparatus. The unheated liquid may have a steam quality of 0%.

As used herein, the term "steam" includes a liquid, such as but not limited to water or solutions containing water (like water mixed with a cleaning chemistry, fragrance, etc.), at least partially converted to a gas or vapor phase. The liquid can be boiled or otherwise at least partially converted to the gas or vapor phase by heating or mechanical action like nebulizing. The steam can be invisible to the naked eye, in the form of a visible vapor that can be observed by the naked eye, or combinations thereof.

As used herein, the terms "visible vapor," "visible steam," or "visible steam vapor" includes steam that can be observed by the naked eye and is therefore visible to a user of the surface cleaning apparatus.

The functional systems of the surface cleaning apparatus can be arranged into any desired configuration, such as an upright device having a base and an upright body for directing the base across the surface to be cleaned, a canister device having a cleaning implement connected to a wheeled base by a vacuum hose, a lift-off floor cleaner (e.g., a floor cleaner capable of being used as an upright-type cleaner as well as a canister type cleaner), a portable or hand-held device adapted to be hand carried by a user for cleaning relatively small areas, an unattended surface cleaner, such as an unattended spot cleaning apparatus, or an autonomous/ robotic device. At least some of the aforementioned cleaners can be adapted to include a flexible vacuum hose, which can form a portion of a working air path between a nozzle and a suction source.

FIG. 1 is a schematic view of various functional systems of a surface cleaning apparatus in the form of an extraction cleaner 10. The extraction cleaner 10 can include a fluid delivery system 12 including a source of cleaning fluid 14, a heater 16 for heating the cleaning fluid, and a dual-phase distributor 18 including a phase separator 20 that separates a vapor phase of the heated fluid from a liquid phase thereof. A heated liquid outlet 22 dispenses heated liquid and a steam vapor outlet 24 dispenses steam vapor.

The fluid delivery system 12 can include other conduits, ducts, tubing, hoses, connectors, valves, etc. fluidly coupling the components of the system 12 together and providing a supply path 26 from the source of cleaning fluid to the dual-phase distributor 18. It is noted that the heated liquid outlet 22 and/or the steam vapor outlet 24 may include a single outlet opening or a plurality of outlet openings that collectively define an outlet.

The fluid source 14 can stored cleaning fluid in liquid form. The cleaning fluid can comprise one or more of any suitable cleaning fluids, including, but not limited to, water, compositions, concentrated detergent, diluted detergent, etc., and mixtures thereof. For example, the cleaning fluid can comprise water. In another example, the cleaning fluid can comprise a mixture of water and concentrated detergent.

The fluid delivery system 12 can include a flow controller to control the flow of fluid from the source 14 to the heater 16. In one configuration, the flow controller can comprise a pump 28 which pressurizes the path 26 and controls the delivery of heated fluid to the dual-phase dispenser 18. In one example, the pump 28 can be a centrifugal pump. In another example, the pump 28 can be a solenoid pump.

In some embodiments, the pump 28 can have multiple speeds and/or flow rates so that a flow rate of cleaning fluid out of the dual-phase dispenser 18 can be varied. The extraction cleaner 10 can have an input control (not shown) that controls the speed and/or flow rate of the pump 28.

A first conduit 30 leads from the source 14 to an inlet 32 of the pump 28. A second conduit 34 leads from an outlet 36 of the pump 28 to an inlet 38 of the heater 16 to supply cleaning fluid under pressure to the heater 16. A third conduit 44 leads from an outlet 40 of the heater 16 to an inlet 42 of the phase separator 20. The conduits 30, 34, 44 can include one or more ducts, tubing, hoses, etc. fluidly coupling the components together.

The heater 16 preferably heats the cleaning fluid to about 100° C., where "about" includes ±10° C. This temperature may be the temperature at the outlet 40 of the heater 16. The heater 16 itself may operate at a higher temperature, such as around 130° C. Some heat loss between the outlet 40 of the heater 16 and the phase separator 20 is possible, particularly when the system and its components are heating up and pressurizing. Once a "steady state" is reached, the heated fluid may be about 90 to 100° C., alternatively about 95 to 98° C., measured at the phase separator 20. Some non-limiting examples of a suitable heater 16 include, but are not limited to, a flash heater, a boiler, an immersion heater, and a flow-through steam generator.

Prior to reaching the phase separator 20, the heated fluid may include cleaning fluid in a mixture of vapor phase and liquid phase. For example, at the heater outlet 40 the heated fluid can have a steam quality of around 20 to 30%, alternately about 24%.

It is noted that the steam quality of the heated fluid that reaches the phase separator 20 may change over time, for example depending on how long a trigger 52 or other control actuator is depressed. When the trigger 52 is initially depressed, the steam quality may be higher and may decrease until a steady state is reached.

The phase separator 20 can include a chamber 46 including or otherwise in fluid communication with the inlet 42, a liquid discharge port 48, and a upper vapor discharge port 50. The chamber 46 may be enclosed save for the inlet 42 and two discharge ports 48, 50.

The phase separator 20 can use gravity to cause denser cleaning fluid, e.g. heated liquid, to settle toward the bottom of the chamber 46 and less dense cleaning fluid, e.g. vapor, to rise toward the top of the chamber 46. The liquid that settles can drain by gravity through the liquid phase discharge port 48. The vapor phase discharge port 50 can be positioned higher than the liquid phase discharge port 48 so that liquid does not exit through the vapor phase discharge port 50. The separated steam vapor is pushed out of the vapor phase discharge port 50 by pressure generated within the heater 16 and, optionally, by pressure generated by the pump 28.

The liquid phase of the heated fluid dispensed by the heated liquid outlet 22 is substantially in a liquid state, and is preferably within a temperature range of about 90 to 100° C., alternatively about 95 to 98° C. Applying heated liquid within this temperature range is effective at cleaning soft surfaces such as carpet, while not being damaging to typical flooring surfaces. Other temperature ranges are possible, and may depend on one of more of the cleaning fluid, the type of surface to be cleaned (e.g. carpet vs. hard floor, wool carpet vs. nylon carpet), or the type of dirt to be removed from the surface to be cleaned.

The vapor phase of the heated fluid dispensed by the steam vapor outlet 24 is substantially in a gaseous state, and is preferably within a temperature range of about 90 to 100° C., alternatively about 95 to 98° C. Other temperature ranges for the vapor phase are possible depending on the cleaning fluid. The temperature of the vapor phase of the heated fluid dispensed by the steam vapor outlet 24 is generally similar in temperature to the liquid phase of the heated fluid dispensed by the heated liquid outlet 22, although some variation is possible.

In some embodiments, the phase separator 20 may integrated with the heated liquid outlet 22 and/or the steam vapor outlet 24. For example, the phase separator 20 may be integrally formed with another portion of the dual-phase distributor 18 as a one-piece part manufactured, for example, via molding or an additive manufacturing process, e.g. a 3-D printing process. Of course, various other methods and/or combinations of methods may also be utilized, including stamping, casting, etc.

In other embodiments, the phase separator 20 may be remote from a portion of the dual-phase distributor 18 including the heated liquid outlet 22 and/or the steam vapor outlet 24. For example, the phase separator 20 can be located at a distance from the heated liquid outlet 22 and/or the steam vapor outlet 24, and require conduits, ducts, tubing, hoses, etc. routed through the extraction cleaner 10 to fluidly couple the discharge ports 48, 50 to the outlets 22, 24.

The fluid source 14 can include at least one supply container 56 for storing a supply of cleaning fluid. In yet another configuration, the fluid delivery system 12 can have an additional supply container 58 for storing a liquid cleaning fluid. For example the first supply container 56 can store water and the second supply container 58 can store a cleaning agent such as detergent. The supply containers 56, 58 can, for example, be defined by a supply tank and/or a collapsible bladder. Alternatively, a single container can define multiple chambers for different cleaning fluids.

In embodiments where multiple supply containers 56, 58 are provided, the system 12 can have with a mixing system for controlling the composition of the cleaning fluid that is delivered to the surface. The composition of the cleaning fluid can be determined by the ratio of cleaning fluids mixed together by the mixing system. In one non-limiting example, the mixing system includes a mixing valve 60 fluidly coupled with an outlet of the second supply container 58, whereby when mixing valve 60 is open, the second cleaning fluid will mix with the first cleaning fluid flowing out of the first supply container 56. By controlling the time that the mixing valve 60 is open, the composition of the cleaning fluid that is delivered to the surface can be selected. Other mixing systems are possible, such as mixing systems with manifolds and controllable orifices.

In certain embodiments, the extraction cleaner 10 can include a liquid delivery system 62 to deliver liquid to the surface to be cleaned. With both the fluid delivery system 12 and the liquid delivery system 62, the extraction cleaner 10 can selectively deliver unheated liquid, heated liquid and/or steam to the surface to be cleaned.

Appropriate switches, buttons, actuators, and the like can be provided for user control of the systems 12, 62, including dispensing unheated liquid only, heated liquid and steam only, or a combination of unheated liquid, heated liquid, and steam simultaneously to the surface to be cleaned. For example, the release of cleaning fluid can be controlled by a trigger 52, where depressing the trigger 52 releases cleaning fluid from the dual-phase distributor 18 and the liquid dispenser 64. In some embodiments, release of cleaning fluid from the dual-phase distributor 18 and the liquid dispenser 64 upon depression of the trigger 52 can be mode-dependent. In yet another embodiment, a separate actuator (not shown) controls steam dispensing, while the trigger 52 controls liquid dispensing.

As shown in FIG. 1, in one embodiment, the liquid delivery system 62 includes at least one liquid dispenser 64 supplied with liquid cleaning fluid from a source of cleaning fluid. The liquid delivery system 62 can share the same fluid source 14 as the fluid delivery system 12, e.g. the supply container 56 or dual supply containers 56, 58. In another embodiment, the extraction cleaner 10 can include a separate supply container (not shown) for storing a cleaning fluid for the liquid delivery system 62.

Regardless of the source of the cleaning fluid, the liquid delivery system 62 can include other conduits, ducts, tubing, hoses, connectors, valves, etc. fluidly coupling the components of the liquid delivery system 62 together and providing a liquid supply path 66 from the source of cleaning fluid to a liquid dispenser 64. In embodiments where the fluid source 14 is shared, a manifold splitter 68 splits liquid between the steam supply path 26 and the liquid supply path 66. The manifold splitter 68 can include a first outlet in fluid communication with the steam supply path 26, including the heater 16 and the dual-phase distributor 18, and second outlet in fluid communication with a liquid supply path 66, including the liquid dispenser 64.

The liquid delivery system 62 can include a flow controller for controlling the flow of fluid from the source 14 to the liquid dispenser 64. In one configuration, the flow controller can comprise a pump 70 which pressurizes the path 66 and controls the delivery of liquid cleaning fluid to the liquid dispenser 64. In one example, the pump 70 can be a centrifugal pump. In another example, the pump 70 can be a solenoid pump.

A first conduit 72 leads from the source 14 to an inlet 74 of the pump 70. A second conduit 76 leads from an outlet 78 of the pump 70 to an inlet 80 of the liquid dispenser 64 to supply liquid cleaning fluid under pressure. The conduits 72, 76 can include one or more ducts, tubing, hoses, etc. fluidly coupling the components together.

In some embodiments, the pump 70 can have multiple speeds and/or flow rates so that a flow rate of cleaning fluid out of the liquid dispenser 64 can be varied. The extraction cleaner 10 can have an input control (not shown) that controls the speed and/or flow rate of the pump 70.

The liquid dispenser 64 can include at least one liquid outlet 82 for dispensing liquid cleaning fluid to the surface to be cleaned. The at least one outlet 82 can be positioned to deliver liquid cleaning fluid directly to the surface to be cleaned, or indirectly by delivering liquid cleaning fluid onto an agitator (not shown). In one non-limiting example, the at least one outlet 82 delivers liquid cleaning fluid between two horizontally-rotating brushrolls.

The liquid dispenser 64 can comprise any structure, such as a nozzle, a spray tip, or a manifold, and can comprise one or multiple outlets 82. In one non-limiting example, the liquid dispenser 64 is a spray manifold having multiple outlets 82.

In certain embodiments, the liquid provided to the liquid dispenser 64 does not pass through the heater 16 and/or is otherwise unheated, and is at the same temperature as the fluid source 14. In other embodiments, the liquid provided to the liquid dispenser 64 passes through a heater (not shown) or is otherwise heated to a temperature that is less than the temperature of the heated liquid dispensed by the heated liquid outlet 22. Such a heater can be located downstream of the fluid source 14 and upstream of the pump 70. In yet another example, the cleaning fluid can be heated using exhaust air from a motor-cooling pathway for a motor/fan assembly.

In one configuration, the liquid dispenser 64 can dispense liquid cleaning fluid at a rate of 1600 to 2100 ml/min, alternatively about 1740 ml/min. The extraction cleaner 10 can also have a low flow cleaning mode, where the liquid dispenser 64 can dispense liquid cleaning fluid at a rate of 145 to 185 ml/min.

In one configuration, the dual-phase distributor 18 can dispense cleaning fluid at a rate of 52 to 90 ml/min, alternatively 75 to 80 ml/min. A portion of this is dispensed through the steam vapor outlet 24 as steam vapor, and the remainder is dispensed through the heated liquid outlet 22 as heated droplets. For example, the heated liquid outlet 22 can dispense steam vapor at a rate of 41 to 72 ml/min, alternatively about 60 to 64 ml/min, and the steam vapor outlet 24 can dispense steam vapor at a rate of 10 to 18 ml/min, alternatively at least 12 ml/min, alternatively about 15 ml/min. Alternatively, the dual-phase distributor 18 can dispense cleaning fluid at a rate of about 60 ml/min, with the heated liquid outlet 22 dispensing heated droplets at a rate of about 40-45 ml/min and the steam vapor outlet 24 dispensing steam vapor at a rate of about 15-25 ml/min steam.

In certain embodiments, the extraction cleaner 10 can include a recovery system 84 to remove liquid and/or dirt from the surface to be cleaned and storing the spent cleaning fluid and dirt. The recovery system 84 can include a suction nozzle 86, a suction source 88 in fluid communication with the suction nozzle 86 for generating a working air stream, and a recovery container 90 for separating and collecting fluid and dirt from the working airstream for later disposal.

A separator 92 can be formed in a portion of the recovery container 90 for separating fluid and entrained dirt from the working airstream. The suction source 88, such as a motor/fan assembly, is provided in fluid communication with the recovery container 90.

The suction nozzle 86 can be provided on a base or cleaning head adapted to move over the surface to be cleaned. An agitator 94 can be provided adjacent to the suction nozzle 86 for agitating the surface to be cleaned so that the dirt is more easily ingested into the suction nozzle 86. Some examples of agitators include, but are not limited to, a horizontally-rotating brushroll, dual horizontally-rotating brushrolls, one or more vertically-rotating brushrolls, or a stationary brush. In one non-limiting example, the agitator 94 is two horizontally-rotating brushrolls, and the liquid dispenser 64 delivers liquid cleaning fluid between two horizontally-rotating brushrolls.

The extraction cleaner 10 can also be provided with above-the-floor cleaning features. An above—the floor cleaning tool (not shown) with its own fluid dispenser and suction inlet can be selectively fluidly coupled to at least one of the delivery systems 12, 62 and to the recovery system 84.

Electrical components of the extraction cleaner 10, including the heater 16, pumps 28, 70, and suction source 88, are electrically coupled to a power source 96, such as a battery or by a power cord plugged into a household electrical outlet. Appropriate switches, buttons, actuators, and the like can be provided for user control of the heater 16, pumps 28, 70, and suction source 88, thereby controlling the systems 12, 62, 84 of the extraction cleaner 10.

The application of heated liquid and steam vapor by the dual-phase distributor 18 applies wet heat to the surface to be cleaned. The addition of wet heat introduces elevated energy levels (e.g., heat) to help mobilize various types of dirt and low levels of solvent (e.g., water) to improve dirt transportation away from the surface. Using high temperature liquid, is particularly efficient at removing embedded soils and stains on soft surfaces like carpet. Dirt is freed from the fibers of the soft surface with a combination of chemical and mechanical (e.g. via the agitator 94) interactions, allowing the creation of bonds between the dirt and cleaning fluid. The encapsulated dirt can then be removed from the fibers using suction via the nozzle 86.

In certain embodiments, the vapor phase of the heated fluid dispensed by the steam vapor outlet 24 is dispensed as visible steam, e.g., a visible vapor that can be observed by the naked eye. Dispensing visible steam offers a visual confirmation to the user that steam is being generated and dispensed by the extraction cleaner 10. Further, since the dual-phase distributor 18 also dispenses heated liquid, the visible steam also offers a visual confirmation to the user that heated liquid is being generated and dispensed by the extraction cleaner 10.

As least the steam vapor outlet 24 of the dual-phase distributor 18 can be located in front of the suction nozzle 86. With this spatial arrangement, steam vapor is disposed in front of the suction nozzle 86, which can provide visual confirmation that the extraction cleaner 10 is operating. In one embodiment the steam vapor outlet 24 can dispense steam vapor at a rate of 12 to 20 ml/min with the suction source 88 off, and produce visible steam, e.g., a visible vapor that can be observed by the naked eye.

In some embodiments, the heated liquid outlet 22 and/or the liquid dispenser 64 can be located behind the suction nozzle 86, with the steam vapor outlet 24 located in front of the suction nozzle 86. Since steam vapor does not overly wet the surface to be cleaned, dispensing steam vapor in front of the nozzle 86 provides a visual confirmation that the extraction cleaner 10 is operating without applying a significant volume of fluid to an area of the surface (e.g., near a wall, base board, or furniture) that the suction nozzle 86 cannot reach. Heated and/or unheated liquid is dispensed behind the suction nozzle 86, and can therefore by suctioned up by the nozzle 86.

Figure 2:
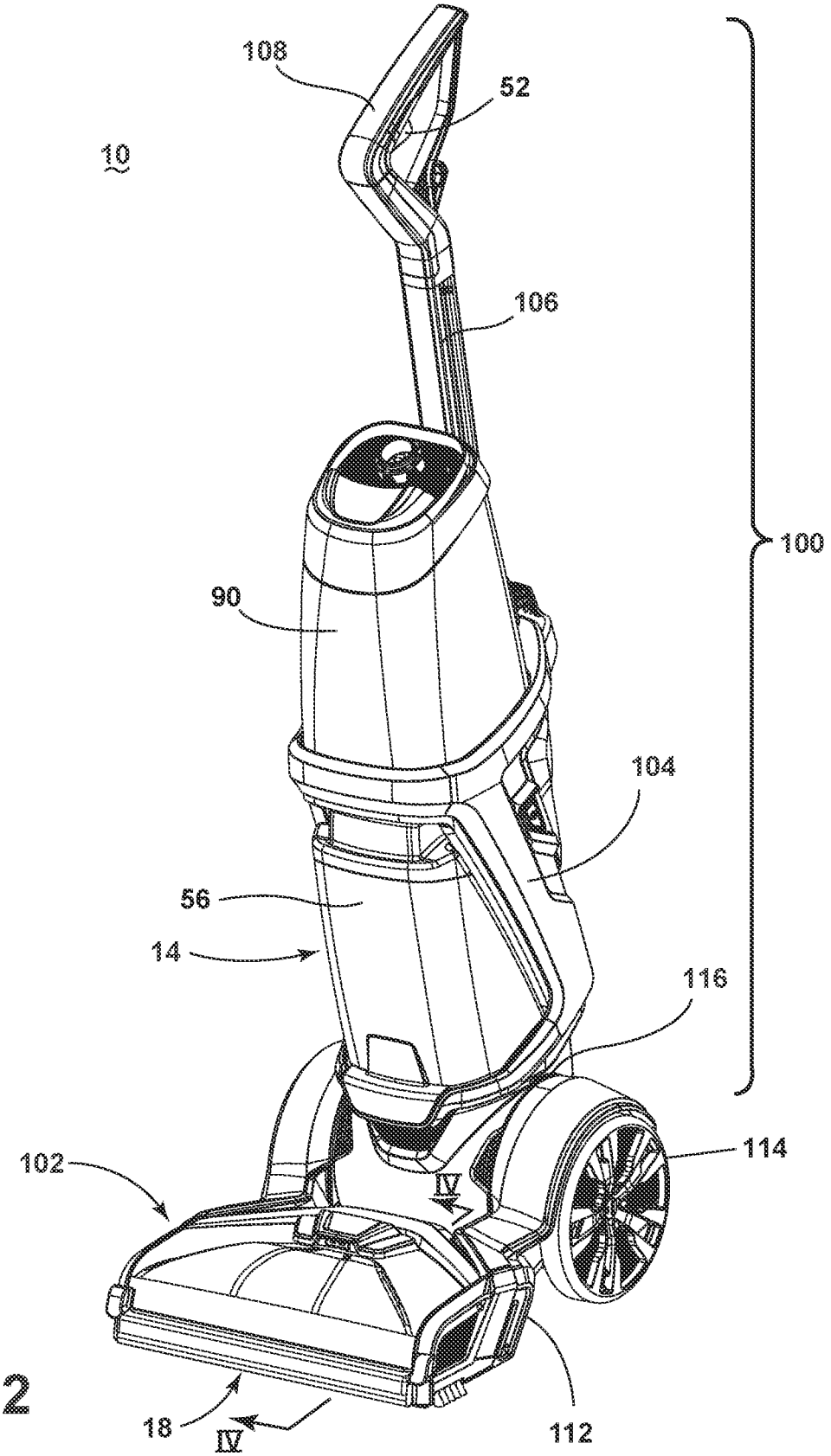
FIG. 2 is a perspective view of the extraction cleaning of FIG. 1 embodied as an upright extraction cleaner.

FIG. 2 shows the extraction cleaner 10 as an upright extraction cleaner having a housing that includes an upright assembly 100 that is pivotally connected to a base 102 for directing the base 102 across the surface to be cleaned. The extraction cleaner 10 can comprise the various systems and components schematically described for FIG. 1, including the dual-phase fluid delivery system 12, the liquid delivery system 62, and the recovery system 84. The various systems and components schematically described for FIG. 1 can be supported by either or both the base 102 and the upright assembly 100.

For purposes of description related to the figures, the terms "upper," "lower," "right," "left," "rear," "front," "vertical," "horizontal," "inner," "outer," and derivatives thereof shall relate to the disclosure as oriented in FIG. 2 from the perspective of a user behind the extraction cleaner 10, which defines the rear of the extraction cleaner 10. However, it is to be understood that the disclosure may assume various alternative orientations, except where expressly specified to the contrary.

The upright assembly 100 can comprise any type of elongated handle, wand, body, or combination thereof suitable for the purposes described herein, including for a user to maneuver the cleaner 10 over a floor surface to be cleaned. In one embodiment, the upright assembly 100 includes a main support section or frame 104 supporting components of the systems 12, 62, 84, including, but not limited to, the recovery container 90 and the supply container 56. The upright assembly 100 also has an elongated handle 106 extending upwardly from the frame 104 that is provided with a hand grip 108 at one end that can be used for maneuvering the extraction cleaner 10 over a surface to be cleaned. A motor housing 110 is formed at a lower end of the frame 104 and contains the suction source 88 positioned therein in fluid communication with the recovery container 90. Other components of the upright assembly 100 may include, but are not limited to, the heater 16, pumps 28, 70, power source 96, and the like, or any combination thereof.

The base 102 can comprise any type of base, foot, or cleaning head suitable for the purposes described herein, including being moved over a floor surface to be cleaned. In one embodiment, the base 102 includes a base housing 112 supporting components of the systems 12, 62, 84, including, but not limited to the dual-phase distributor 18, the liquid dispenser 64, the suction nozzle 86, and the agitator 94. Wheels 114 can at least partially support the base housing 112 for movement over the surface to be cleaned. Other components of the base 102 may include, but are not limited to, the heater 16, pumps 28, 70, a motor for driving the agitator 94, a hose, a squeegee, and the like, or any combination thereof.

A moveable joint assembly 116 can connects the base 102 to the upright assembly 100 for movement of the assembly 100 about at least one axis. In the embodiment shown herein, the upright assembly 100 can pivot up and down about at least one axis relative to the base 102. The joint assembly 116 can alternatively comprise a universal joint, such that the upright assembly 100 can swivel about its longitudinal axis in addition to pivoting relative to the base 102. The upright assembly 100 can pivot, via the joint assembly 116, between an upright or storage position, an example of which is shown in FIG. 2, and a reclined or use position (not shown), in which the upright assembly 100 is pivoted rearwardly to form an acute angle with the surface to be cleaned.

Wiring and/or conduits can optionally supply electricity, air, liquid and/or steam between the upright assembly 100 and the base 102, or vice versa, and can extend though the joint assembly 116. As such, in some embodiments, a portion of the systems 12, 62, 84 can extend through the joint assembly 116. For example, the steam supply path 26 and the liquid supply path 66 can extend through the joint assembly 116.

Figure 3:
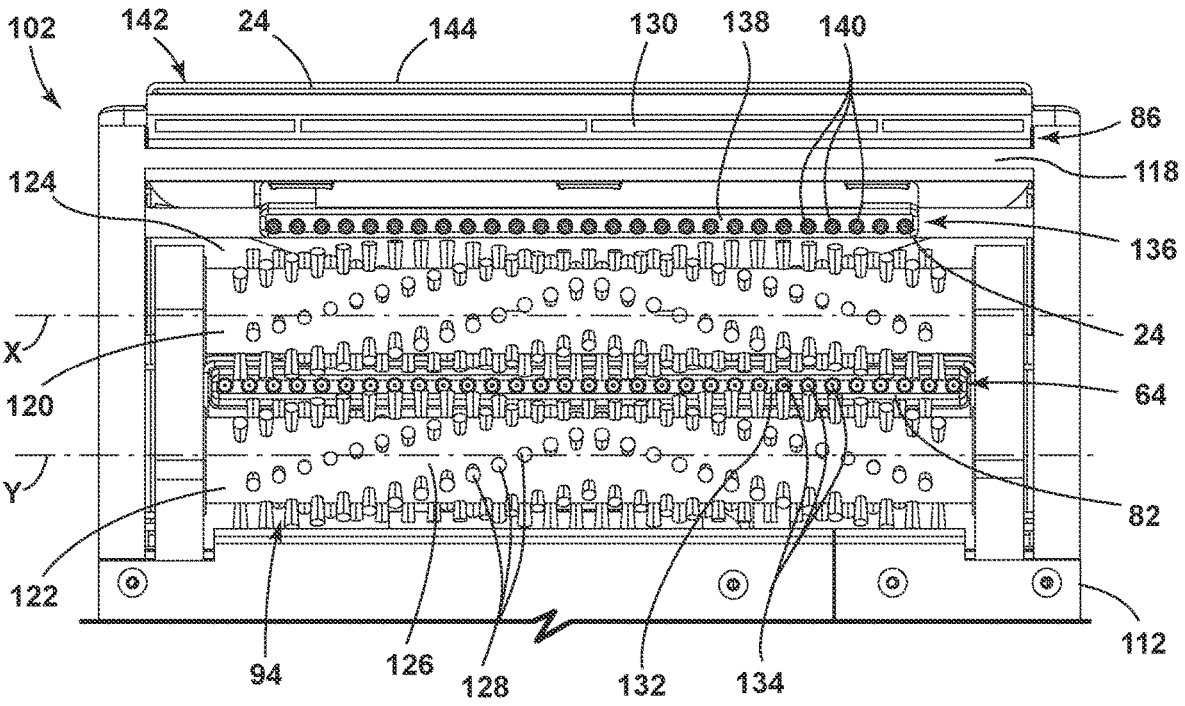
FIG. 3 is a bottom view of a front portion of a base for the extraction cleaner from FIG. 2, the base having a liquid distributor and a dual-phase fluid distributor according to a first aspect of the present disclosure.

FIG. 3 is a bottom view of a front portion of the base 102, generally showing an underside 118 of the base 102. The agitator 94 of the illustrated embodiment includes dual horizontally-rotating brushrolls, including a forward brushroll 120 and a rearward brushroll 122, and which are located in a brush chamber 124 on the base 102.

In one embodiment, the brushrolls 120, 122 comprise dowels 126 supporting at least one agitation element. The agitation element can comprise a plurality of bristles 128 extending from the dowel 126. Bristles 128 can be tufted or unitary bristle strips and constructed of nylon, or any other suitable synthetic or natural fiber. In another embodiment, the agitation element can comprise microfiber material provided in addition to or instead of the bristles 128.

The suction nozzle 86 can include a narrow suction pathway defined between spaced nozzle walls or covers, with an opening forming the nozzle inlet 130 at a lower end thereof. The nozzle inlet 130 is disposed forwardly of the agitator 94. It is noted that nozzle inlet 130 can be single opening extending substantially the entire width of the base 102, or a plurality of smaller openings separated by ribs as shown in FIG. 3, the ribs serving the reinforce the suction nozzle 86.

The liquid dispenser 64 includes a spray manifold 132 having multiple outlets 82 that deliver liquid cleaning fluid between the brushrolls 120, 122. The spray manifold 132 can have a plurality of spray tips 134 which project downwardly in the area between the brushrolls 120, 122, each spray tip 134 having one outlet 82. In some configurations, the outlets 82 may dispense liquid cleaning fluid onto a portion of the brushrolls 120, 122, in addition to or instead of dispensing liquid cleaning fluid onto the surface to be cleaned underneath the base 102. In another embodiment, a single horizontally-rotating brushroll is provided, and the spray manifold 132 can be disposed in front of, behind, or over the top of the brushroll.

To distribute heated liquid, the dual-phase distributor 18 can include a heated liquid dispenser 136 comprising multiple heated liquid outlets 22 that deliver heated liquid onto the surface to be cleaned underneath the base 102. The heated liquid dispenser 136 is provided within the interior of the base housing 112, such as within the brush chamber 124, and is disposed in front of the brushrolls 120, 122 and behind the suction nozzle 86. As such, when moving the base 102 in a forward cleaning stoke, heated liquid is dispensed to the surface to be cleaned before the surface is agitated by the brushrolls 120, 122. In another embodiment of the extraction cleaner 10, a single horizontally-rotating brushroll is provided, and the heated liquid dispenser 136 can be disposed in front of the single brushroll.

The heated liquid dispenser 136 includes a manifold 138 having multiple outlets 22 spaced along its length. The manifold 138 can be transversely-elongated to encourage heated liquid to spread across the length of the heated liquid dispenser 136 to distribute heated liquid evenly to each outlet 22. For example, the manifold 138 may be elongated laterally to span more than 50% of a width of the base 102, alternatively more than 75% of a width of the base 102. In one embodiment, the manifold 138 can be elongated in a direction parallel to a rotational axis X, Y of one or both of the brushrolls 120, 122.

The manifold 138 can have a plurality of spray tips 140 which project downwardly, each spray tip 140 defining one heated liquid outlet 22. In some configurations, the tips 140, or at least the outlets 22 of the tips 140, are disposed in the brush chamber 124. When viewed from the bottom as shown in FIG. 3, the tips 140 are disposed in a row located in front of the front brushroll 120. As such, on a forward stroke of the base 102, heated liquid is dispensed to the surface to be cleaned before the surface is agitated by the brushrolls 120, 122.

Alternatively to having a plurality of outlets 22 and/or tips 140, the heated liquid dispenser 136 can have a single, narrow slit-like opening, a plurality of slits or openings of other shapes, including a plurality of openings of uniform or varying size.

The outlet diameter of the heated liquid outlets 22 may be smaller than the outlet diameter of the unheated liquid outlets 82. In one embodiment, the outlet diameter of the heated liquid outlets 22 is approximately 0.5 mm and the outlet diameter of the liquid outlets 82 may be approximately 0.8 to 1.0 mm. It is noted that the outlet diameter of the outlets 22, 82 may be constant or may vary across the dispensers 64, 136.

To distribute steam vapor, the dual-phase distributor 18 can include a steam dispenser 142 having a steam manifold 144 positioned at a front of the base 102 and comprising the steam vapor outlet 24 that dispenses steam vapor in front of the suction nozzle 86. In this location, the steam adds wet heat to surface to be cleaned, which can soak into the surface to be cleaned to pre-wet and soften stains and soils. Also, in cases where the dual-phase distributor 18 dispenses visible steam, the visible steam is outputted within a line of sight of the user, thereby offering a visual confirmation to the user that steam is being generated and dispensed by the extraction cleaner 10. Further, since the heated liquid dispenser 136 is hidden under the base 102, the visible steam also offers a visual confirmation to the user that heated liquid is being generated and dispensed by the extraction cleaner 10.

The steam manifold 144 can be transversely-elongated to encourage steam vapor to spread across the length of the steam dispenser 142 to distribute steam vapor evenly across substantially the width of the base 102. For example, the steam manifold 144 is elongated laterally to span more than 50% of a width of the base 102, alternatively more than 75% of a width of the base 102. In one embodiment, the steam dispenser 142 can be elongated in a direction parallel to the axis X, Y of one or both of the brushrolls 120, 122.

Preferably, the heated liquid dispenser 136 and/or steam dispenser 142 extend substantially the entire cleaning path, which may be defined by the width or lateral length of the nozzle inlet 130. The liquid dispenser 64 may also extend substantially the entire cleaning path, and by extension substantially the same length as the heated liquid dispenser 136 and/or steam dispenser 142. By substantially matching the fluid dispensing and suction coverage, the surface area treated by one cleaning pass of the base 102 is maximized for efficient cleaning.

The steam manifold 144 can further be disposed in front of the heated liquid dispenser 136 and in front of the brushrolls 120, 122. In another embodiment of the extraction cleaner 10, a single horizontally-rotating brushroll is provided, and the steam manifold 144 can be disposed in front of the single brushroll.

The steam dispenser 142 generally distributes steam vapor downwardly toward the surface to be cleaned, although it is understood that the steam vapor may or may not reach the surface to be cleaned, as at least a portion of the steam vapor exiting the outlet 24 may rise away from the surface.

The steam dispenser 142 can have a single, narrow slit-like opening forming the steam vapor outlet 24. In one embodiment, the steam vapor outlet 24 can be elongated in a direction parallel to an axis X, Y of one or both of the brushrolls 120, 122. Alternatively to having one outlet 24, the steam dispenser 142 can have a plurality of slits or openings of other shapes, including a plurality of openings of uniform or varying size.

In any embodiment of the dual-phase distributor 18 disclosed herein, the heated liquid dispenser 136 and the steam vapor dispenser 142 can be parts made of a plastic material, and may be manufactured, for example, via injection molding or additive manufacturing, e.g. 3-D printing. It is to be appreciated that other materials and manufacturing methods for the dispensers 136, 142 are possible, including a metal parts manufactured by stamping, casting, etc.

Figure 4:
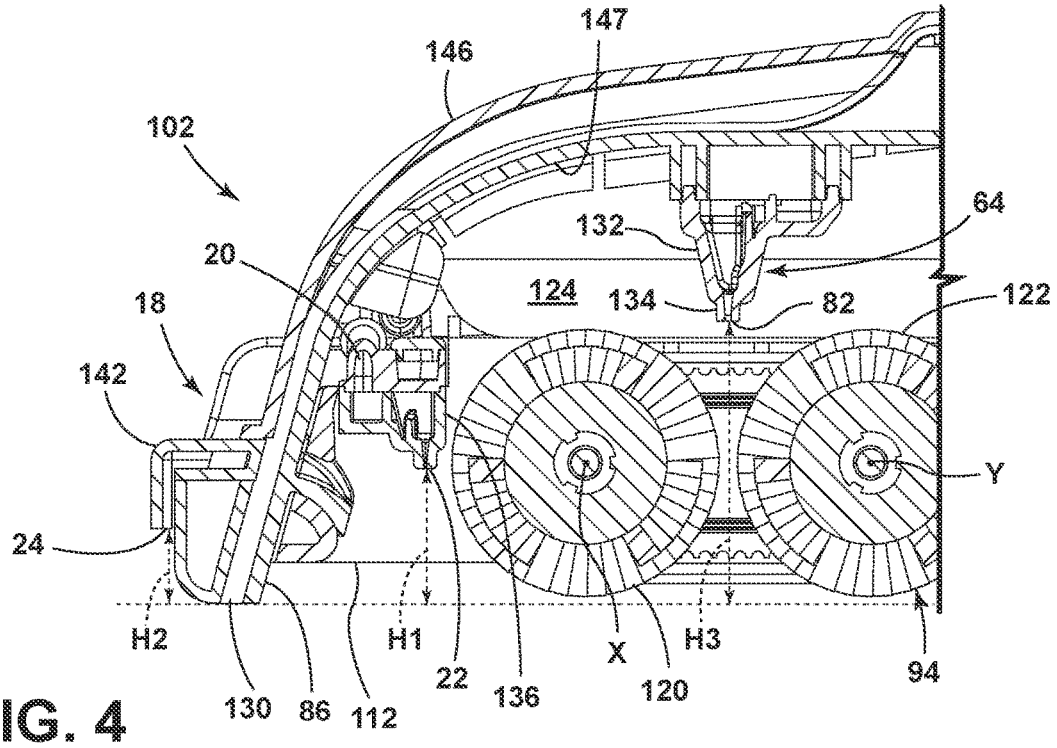
FIG. 4 is a cross-sectional view of the base taken through line IV-IV of FIG. 3.

Referring to FIG. 4, generally, the dual-phase distributor 18 is disposed forwardly of the liquid dispenser 64 and forwardly of the agitator 94. More specifically, the heated liquid outlet 22 of the dual-phase distributor 18 is forward of the liquid dispenser 64 and the agitator 94, and the steam vapor outlet 24 is forward of the heated liquid outlet 22. The suction nozzle 86 is disposed between the steam vapor outlet 24 and the heated liquid outlet 22.

The manifold 144 of the steam vapor dispenser 142 can be positioned on an exterior surface of the suction nozzle 86 and/or on an exterior surface of the base housing 112. In some embodiments, the steam manifold 144 can be removable with a cover 146 of the base 102, the cover 146 defining the suction nozzle 86 and/or the brushroll chamber 124. For removal with the cover 146, the steam manifold 144 can be formed or integrated with, mounted or attached to, coupled, or otherwise joined to the cover 146.

Figure 5:
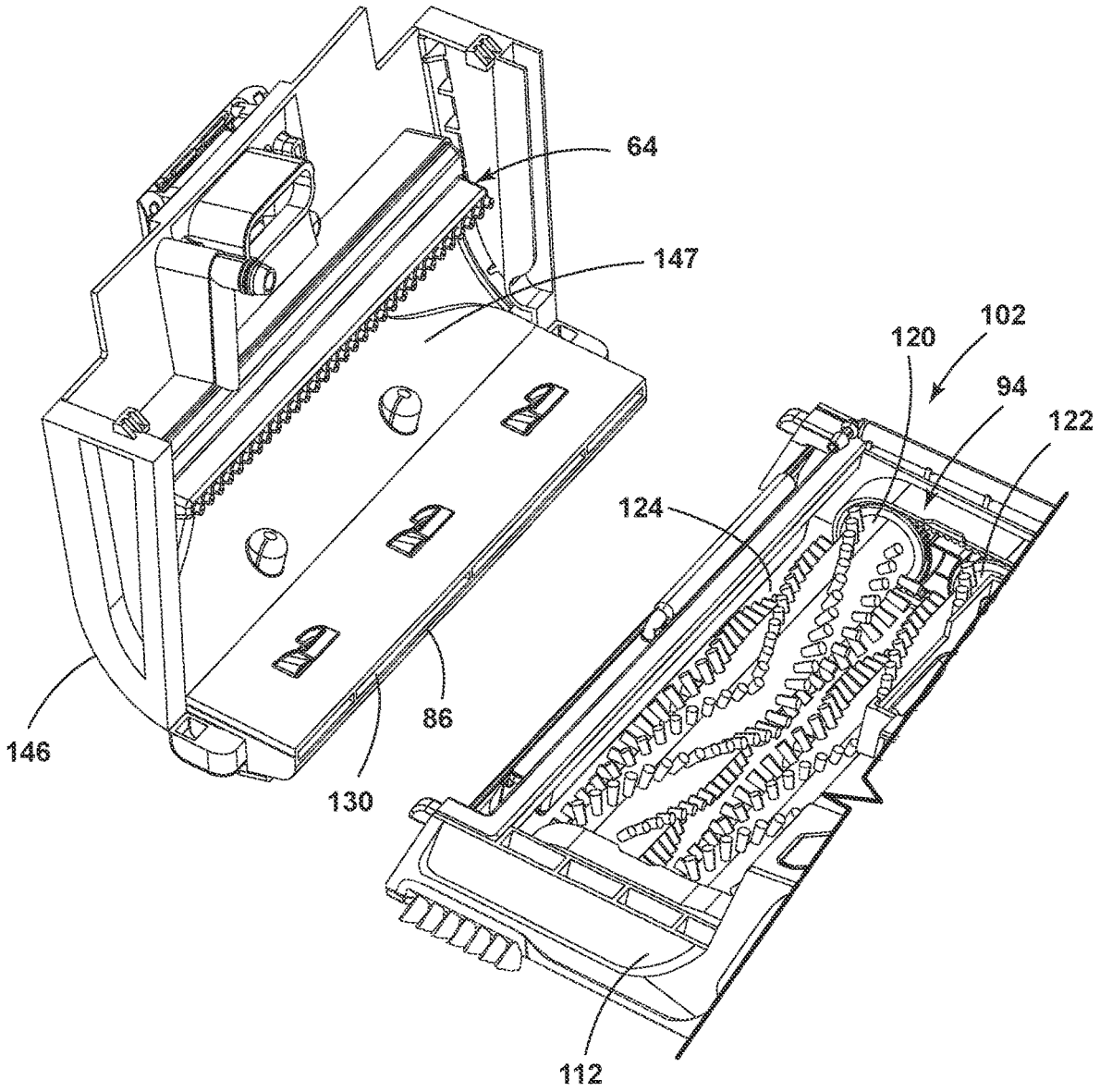
FIG. 5 is a perspective view of the base, showing the removal of a cover from the base.

FIG. 5 shows the cover 146 removed from the base 102. In the illustrated embodiment, the cover 146 defines an upper wall 147 of the brush chamber 124, and removal of the cover 146 can remove the steam manifold 144 from the base 102 while exposing the brushroll 120, 122, and leaving the heated liquid dispenser 136 and phase separator 20 on the base 102. The suction nozzle 86 and the unheated liquid dispenser 64 are also removable as a unit with the cover 146. A portion of the fluid supply pathway to the steam manifold 144 and/or liquid dispenser 64 may remain with the base 102 when the cover 146 is removed.

Figure 6:
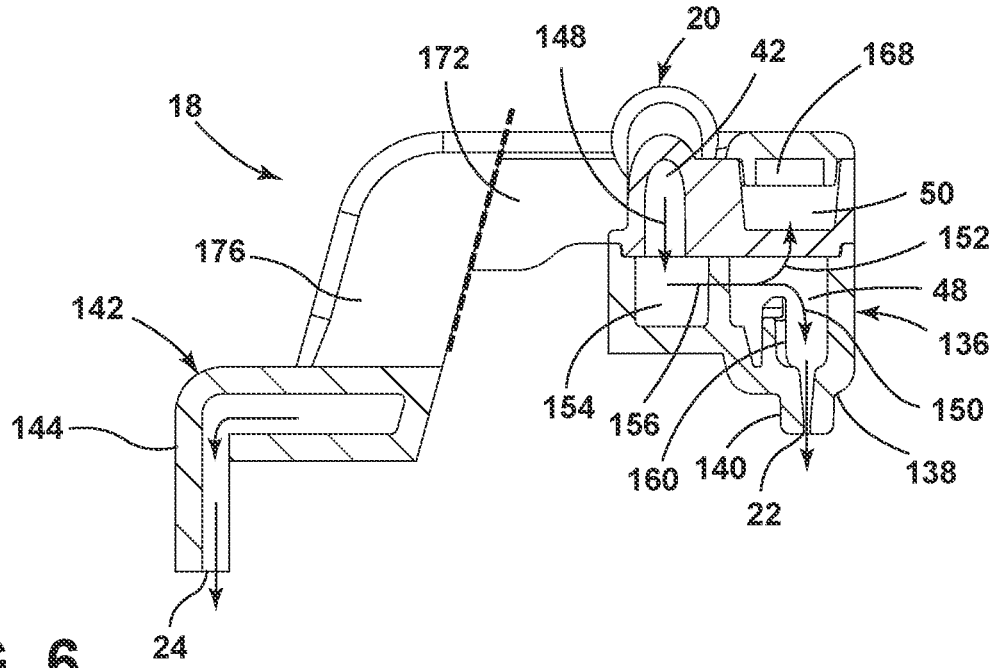
FIG. 6 is a sectional view through the dual-phase distributor from FIG. 3.

Referring to FIG. 6, the phase separator 20 includes the chamber 46 having the inlet 42 that receives heated fluid, a lower liquid discharge port 48, and an upper vapor discharge port 50. In FIG. 6, the incoming heated fluid is represented by arrow 148, the separated liquid phase is represented by arrow 150, and the separated vapor phase is represented by arrow 152.

To encourage separation of the vapor phase of the heated fluid from the liquid phase thereof, the phase separator 20 can include at least one bend 154 of at least a 90° between the inlet 42 and the discharge ports 48, 50. The bend 154 redirects the incoming heated fluid as indicated by arrow 156. The liquid discharge port 48 is disposed below the bend 154, such that liquid flows by gravity through the port 48 and into the liquid dispenser 136. The vapor discharge port 50 is disposed above the bend 154.

In the embodiment shown, the phase separator 20 is integrated with the heated liquid outlet 22. In particular, at least a portion of the phase separator 20 is integrally formed with the heated liquid dispenser 136 during manufacturing of these components (e.g. via injection molding, additive manufacturing, etc.). Producing the phase separator 20 with the dispenser 136 as an injection-molded or additive-manufactured part increases geometric freedom compared to other manufacturing methods. Of course, various other methods and/or combinations of methods may also be utilized.

From the phase separator 20, the separated liquid phase flows through the liquid discharge port 48 to the liquid dispenser 136. The liquid dispenser 136 can include a liquid sump 160 that collects cleaning fluid, e.g. heated liquid. The heated liquid outlet 22 can be located at the bottom of the sump 160. The sump 160 may be a recessed area in the manifold 138, with tips 140 spaced along the manifold to receive liquid from the sump 160. The separated liquid may tend to collect in the sump 160 and will spread out along the length of the dispenser 136. This will ensure a steady flow of heated liquid from all of the outlets 22 (e.g. across the width of the base).

Figure 6A:
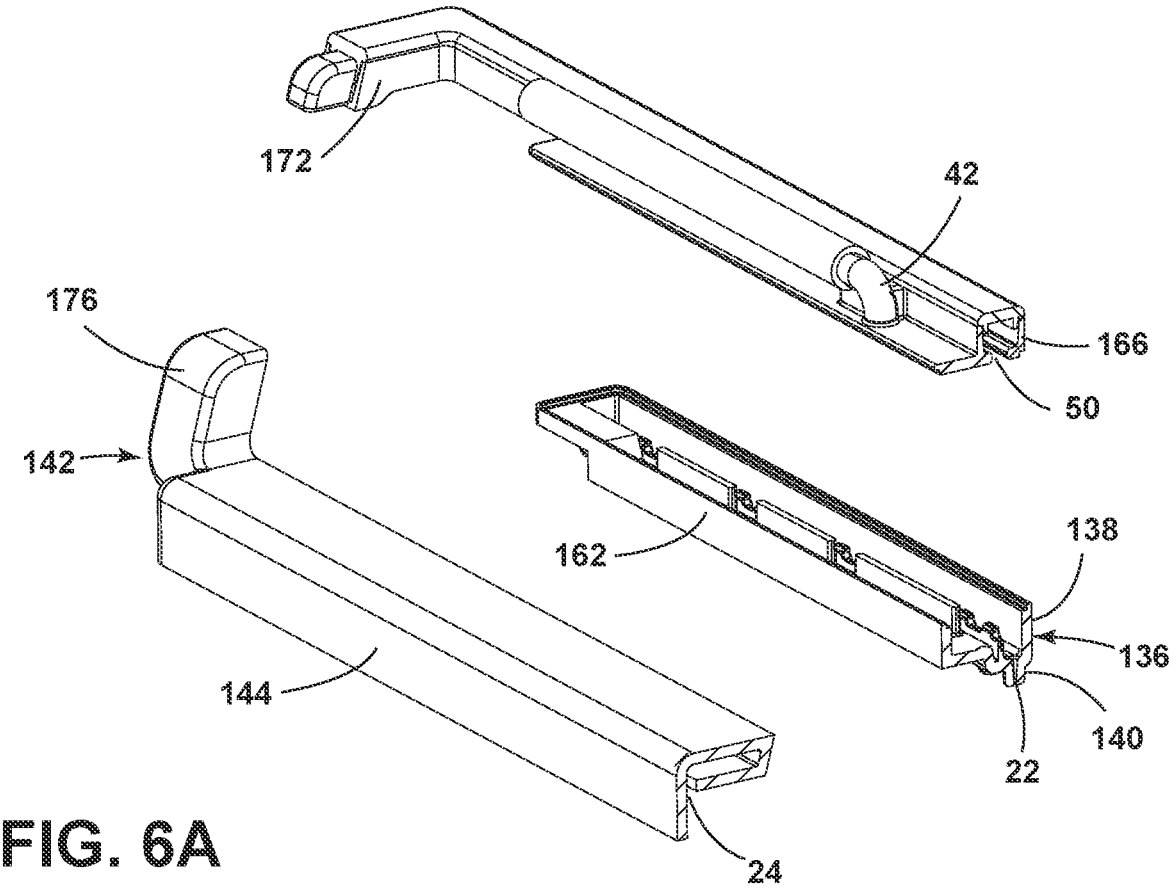
FIG. 6A is an exploded, sectional view of the dual-phase distributor from FIG. 3.

Referring to FIG. 6A, to encourage the liquid phase to spread out evenly across the lateral length of the liquid dispenser 136, the phase separator 20 can include one or more divider walls 202, 204 separated by gaps which define passages 206, 208. The divider walls 202, 204 and passages 206, 208 force the liquid phase to spread out and separate so that even droplets are dispensed from the outlets 22. In the embodiment shown, the phase separator 20 includes a set of first divider walls 202 and passages 206, and a set of second divider walls 204 and passages 208. The second divider walls 204 are downstream, and optionally lower than, the first divider walls 202, such that the liquid phase encounters the first divider walls 202 before the second divider walls 204. The second divider walls 204 may be shorter than the first divider walls 202 in order to provide a greater number of second divider walls 204 and second passages 208. As such, the flowing liquid is divided out twice to provide an even distribution of liquid to the outlets 22.

Figure 7:
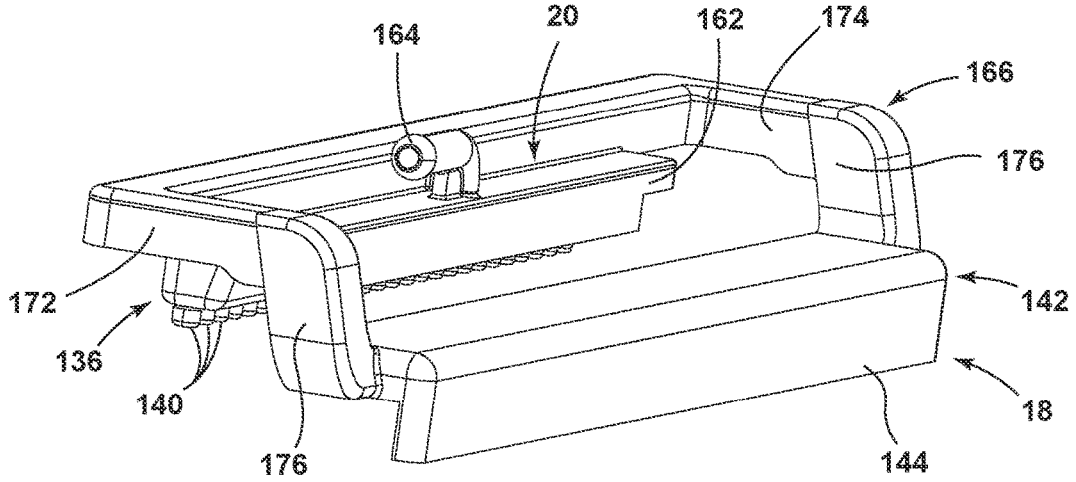
FIG. 7 is a front perspective view of the dual-phase distributor from FIG. 3.
Figure 8:
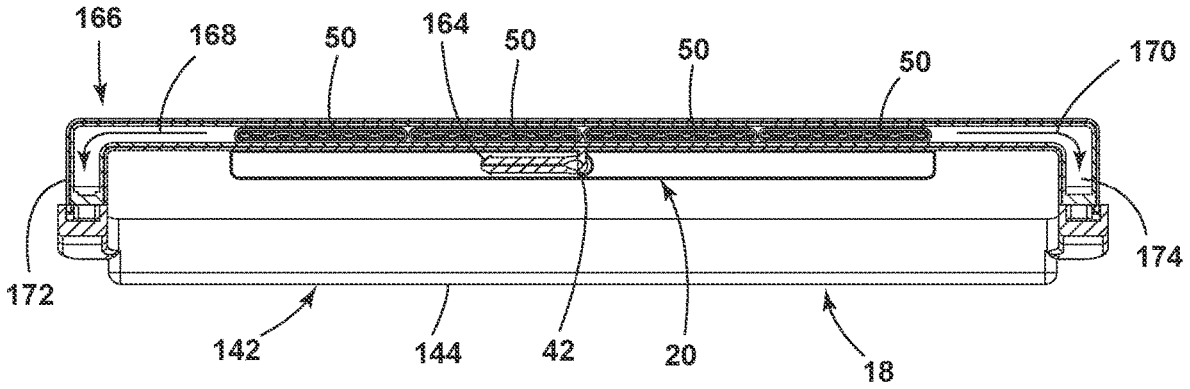
FIG. 8 is a top view of the dual-phase distributor from FIG. 3, with a cap portion of the distributor removed for clarity.
Figure 9:
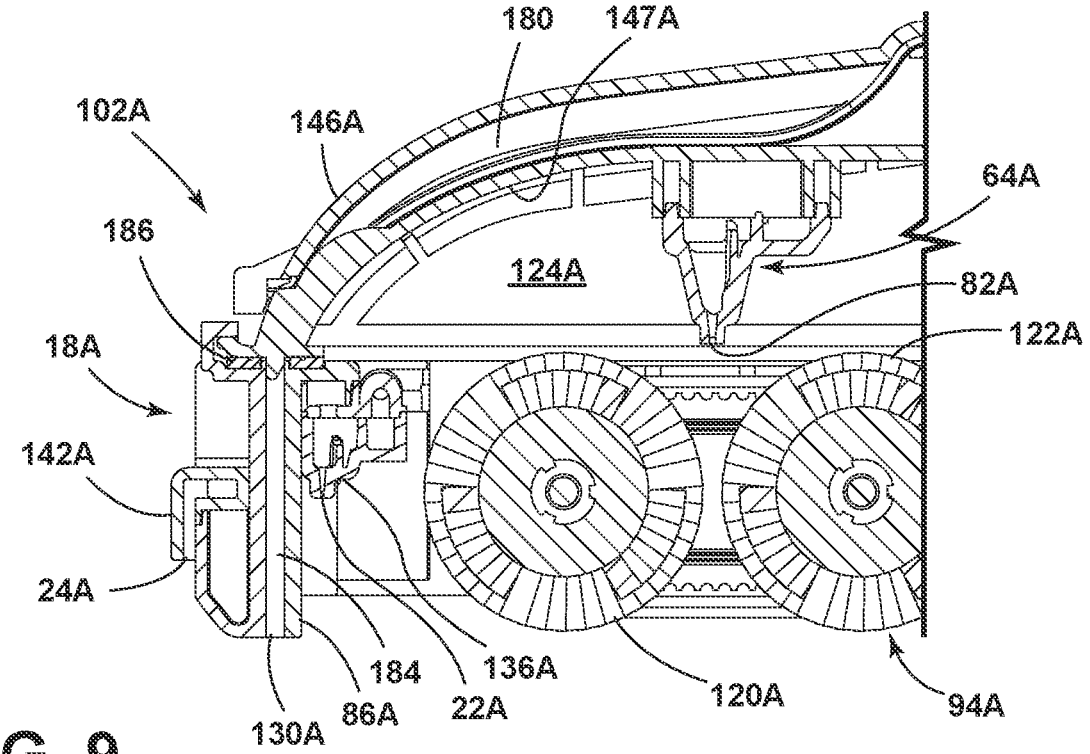
FIG. 9 is a cross-sectional view of a base for the extraction cleaner from FIG. 2, the base having a liquid distributor and a dual-phase fluid distributor according to a second aspect of the present disclosure.
Figure 10:
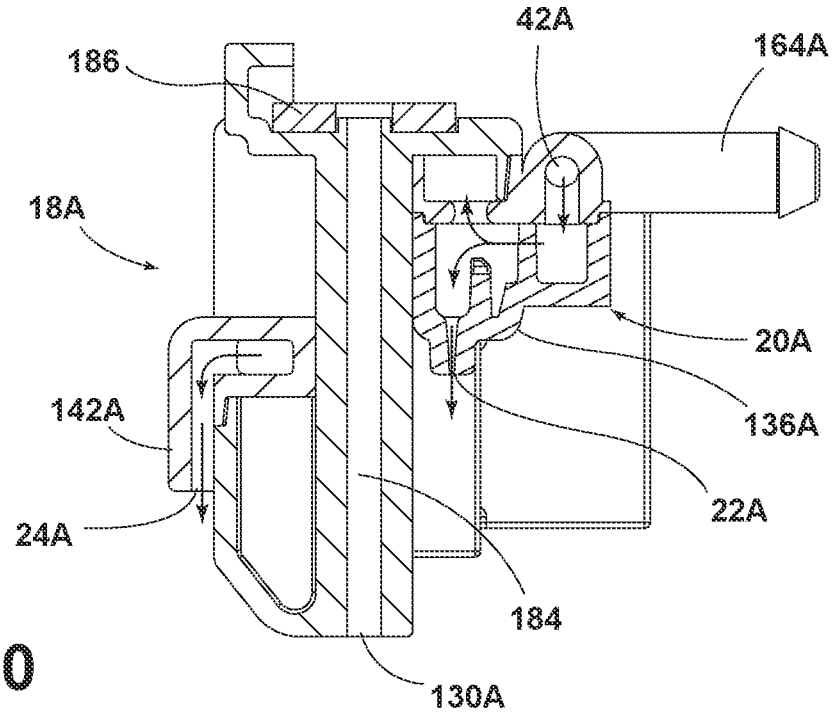
FIG. 10 is a sectional view through the dual-phase distributor from FIG. 9.
Figure 11:
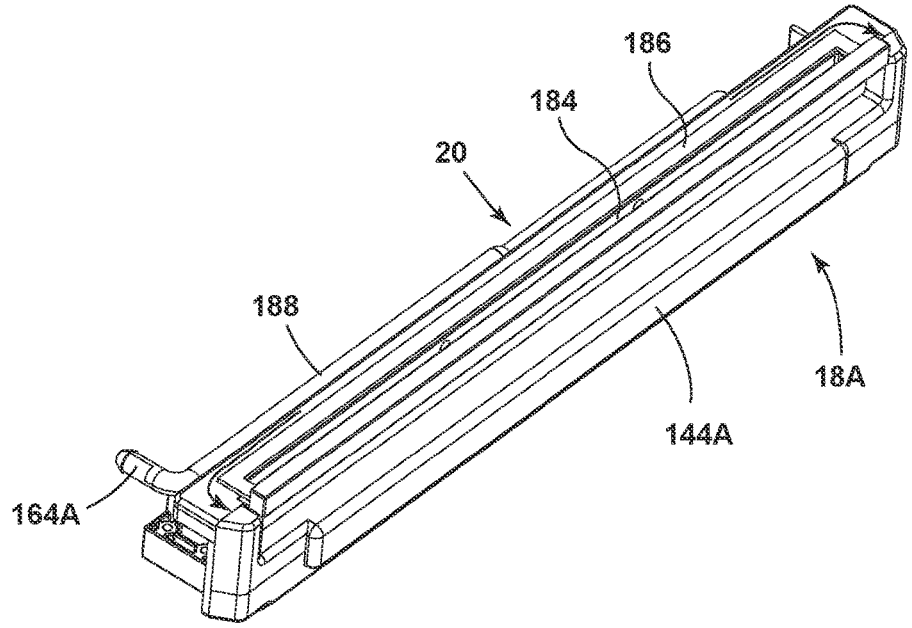
FIG. 11 is a front perspective view of the dual-phase distributor from FIG. 9.
Figure 12:
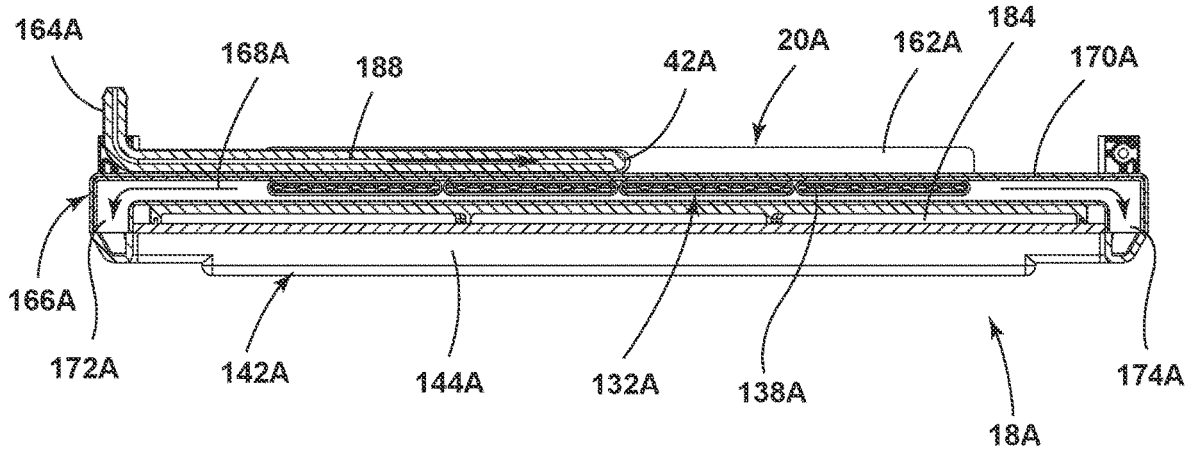
FIG. 12 is a top view of the dual-phase distributor from FIG. 9, with a portion of the distributor removed for clarity.

Referring to FIG. 7-8, to distribute heated fluid laterally, the phase separator 20 can include an elongated separator manifold 162 defining the chamber 46 (FIG. 6). As such, the chamber 46, can be transversely-elongated to encourage heated fluid to spread across substantially the width of the base 102. For example, the separator manifold 162 can be elongated laterally to span more than 50% of a width of the base 102, alternatively more than 75% of a width of the base 102. The phase separator 20 can have multiple discharge ports 48, 50 spaced along the length of the separator manifold 162, or can have a single elongated liquid discharge port 48 and a single elongated vapor discharge port 50.

As can be seen in FIG. 8, the lateral length of the separator manifold 162 is less than the lateral length of the liquid manifold 138 and the steam manifold 144. In other embodiments, the lateral length of the separator manifold 162 may be the same as or greater than the lateral length of the liquid manifold 138 and/or the steam manifold 144.

The inlet 42 of the phase separator 20 can be formed by an inlet tube 164, which may extend from a central portion of the separator manifold 162. With the inlet tube 164 at the center of the separator manifold 162, the incoming heated fluid can spread across the full length of the separator manifold 162. The inlet tube 164 can be a rigid or flexible conduit, and can, for example, connect to the outlet 40 of the heater 16 via conduit 44 (see FIG. 1), which may be a flexible conduit or tubing which is routed through the base housing 112 (see FIG. 2), and which can be optionally routed through a portion of the upright assembly 100, depending on the location of the heater 16.

From the phase separator 20, the separated vapor phase flows through the vapor discharge port 50 to the steam dispenser 142. The steam dispenser 142 can include a vapor discharge conduit 166 to supply the separated vapor phase to the steam manifold 144. With the phase separator 20 on the interior of the base 102 and the steam manifold 144 on the exterior of the base 102, the vapor discharge conduit 166 may extend from an interior of the base 102 to the exterior of the base 102.

The vapor discharge conduit 166 can be a rigid or flexible conduit, such as at least one duct, tubing, hose, or combination thereof, fluidly coupling the vapor discharge port 50 to at least one inlet of the steam manifold 144. In the embodiment shown, the vapor discharge conduit 166 includes lateral ducts 168, 170 that extend on opposite sides of the inlet tube 164 and transverse ducts 172, 174 that extend forwardly from the outer ends of the lateral ducts 168, 170 to port steam vapor around the suction nozzle 86, with the transverse ducts 172, 174 connecting to opposing ends of the steam manifold 144. Other configurations for the vapor discharge conduit 166 are possible, including a configuration where the vapor discharge conduit 166 to only one inlet of the steam manifold 144.

A portion of the vapor discharge conduit 166 can be integrated with the phase separator 20 and/or the liquid dispenser 136. To conserve space within the base 102, the lateral ducts 168, 170 can be stacked with the liquid manifold 138, with the lateral ducts 168, 170 extending over the top of the liquid manifold 138.

With the steam manifold 144 removable with the cover 146, at least a portion of the vapor discharge conduit 166 may remain with the base 102 when the cover 146 is removed. Referring to FIG. 6-7, in the embodiment shown, at least forward portions 176 of the transverse ducts 172, 174 are removable with the cover 146.

The various fluid outlets 22, 24, 82 of the extraction cleaner 10 may be disposed at different heights for effective cleaning and treatment of the surface to be cleaned. Referring to FIG. 4, in one configuration, the height H1 of the heated liquid outlet 22 may be greater than the height H2 of the steam vapor outlet 24 and less than the height H3 of the liquid dispenser outlet 82. The outlet heights H1, H2, H3 may be the distance from the outlet 22, 24, 82 to the underside 118 of the base 102, which may be a bottom-most surface of the base 102 and/or surface that engages the surface to be cleaned. In FIG. 4, the suction nozzle inlet 130 is formed in the underside 118 of the base 102, and so the outlet heights H1, H2, H3 are also the distance from the outlet 22, 24, 82 to the suction nozzle inlet 130. Thus, the heated liquid outlets 22, the steam vapor outlet 24, and the liquid dispenser outlet 82 terminate above the suction nozzle inlet 130.

In one embodiment, the height H1 of the heated liquid outlets 22 is about 20 mm, the height H2 of the steam vapor outlet 24 is about 9.75 mm, and the height H3 of the liquid dispenser outlet 82 is about 20 to 25 mm, alternatively about 23 mm, where "about" includes ±1 mm Other outlet heights and combinations of outlet heights are possible.

FIGS. 9-12 show a dual-phase distributor 18A according to yet another aspect of the present disclosure. The dual-phase distributor 18A is substantially similar to the dual-phase distributor 18 of FIGS. 3-8, and like elements are referred to with the same reference numeral bearing a letter "A." The dual-phase distributor 18A differs by remaining with the base 102A when the cover 146A is removed. In this embodiment the cover 146A, which defines an upper nozzle portion 180 of the suction nozzle 86A and the upper wall 147A of the brush chamber 124A, and is removable from a lower nozzle portion 184 of the suction nozzle 86A. The lower nozzle portion 184 includes the suction nozzle inlet 130A and is disposed between the heated liquid outlets 22A and the steam vapor outlet 24A. A seal 186 at the interface between the cover 146A and the lower nozzle portion 184 can ensure a fluid-tight suction pathway.

Another difference is that, while the inlet 42A of the phase separator 20A is at a center of the separator manifold 162A, the inlet tube 164A of the phase separator 20A is at one lateral end of the separator manifold 162A. To connect the inlet tube 164A with the inlet 42A, a rigid inlet duct 188 runs from the lateral end to the center of the separator manifold 162A.

Yet another difference is that the phase separator 20 is disposed at the rear of the dual-phase distributor 18A and the liquid dispenser 136 is disposed closer to the suction nozzle 86. Heated fluid entering the phase separator 20 at the rear of the dual-phase distributor 18A flows forwardly to be separated into its vapor and liquid phases.

Figure 13:
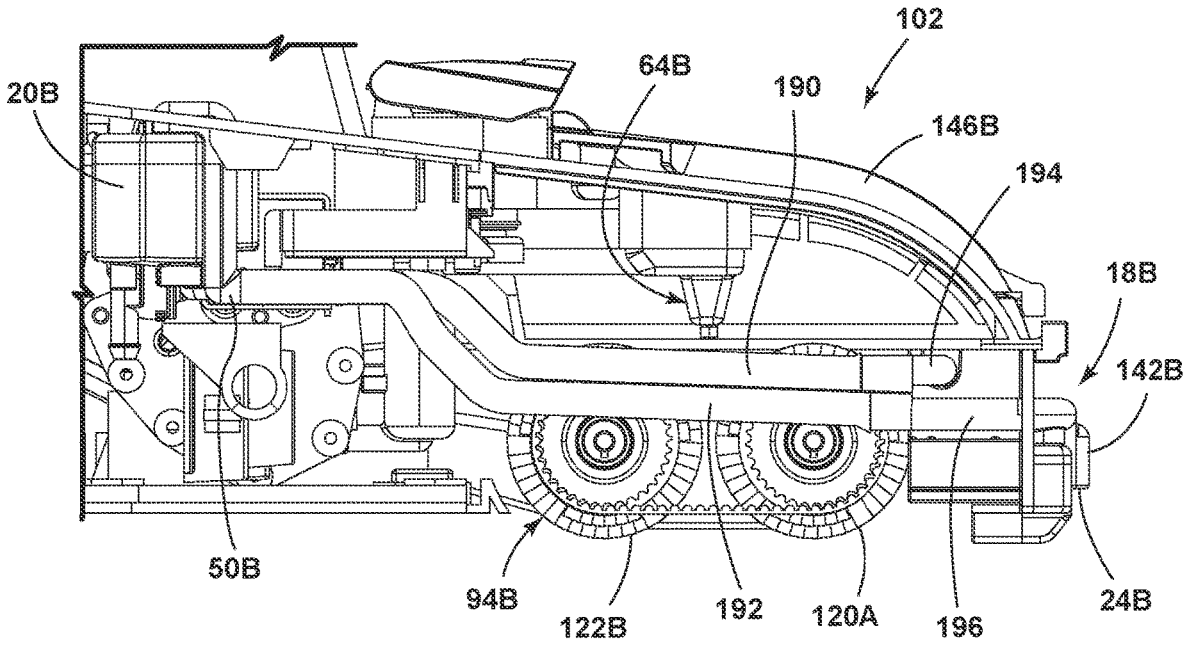
FIG. 13 is a cross-sectional view of a base for the extraction cleaner from FIG. 2, the base having a liquid distributor and a dual-phase fluid distributor according to a third aspect of the present disclosure, and in which several components of the base are not shown for clarity.
Figure 14:
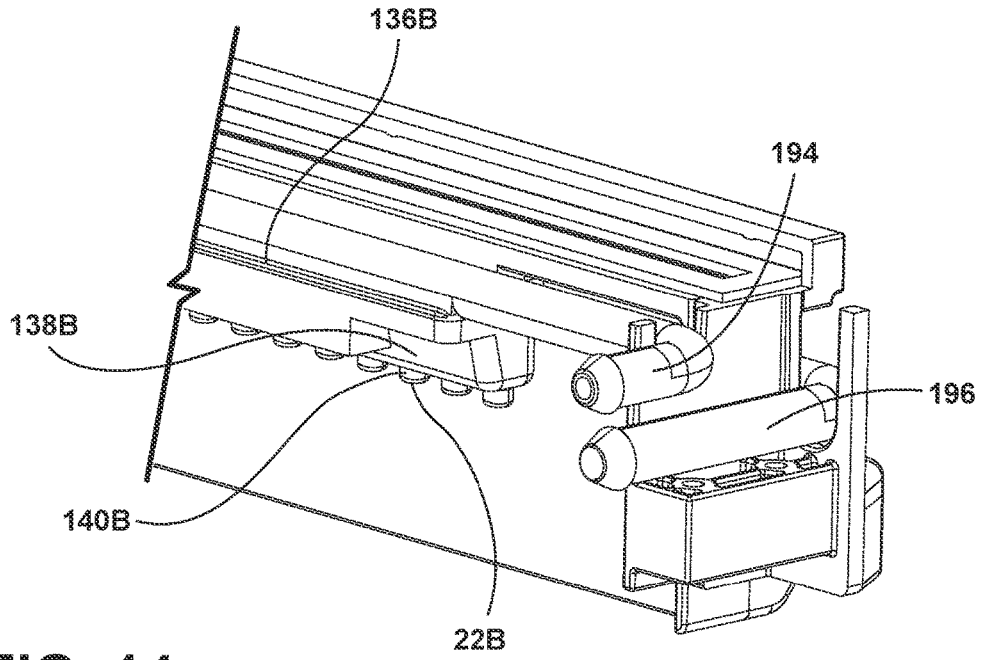
FIG. 14 is a rear perspective view of a portion of the dual-phase distributor from FIG. 13.
Figure 15:
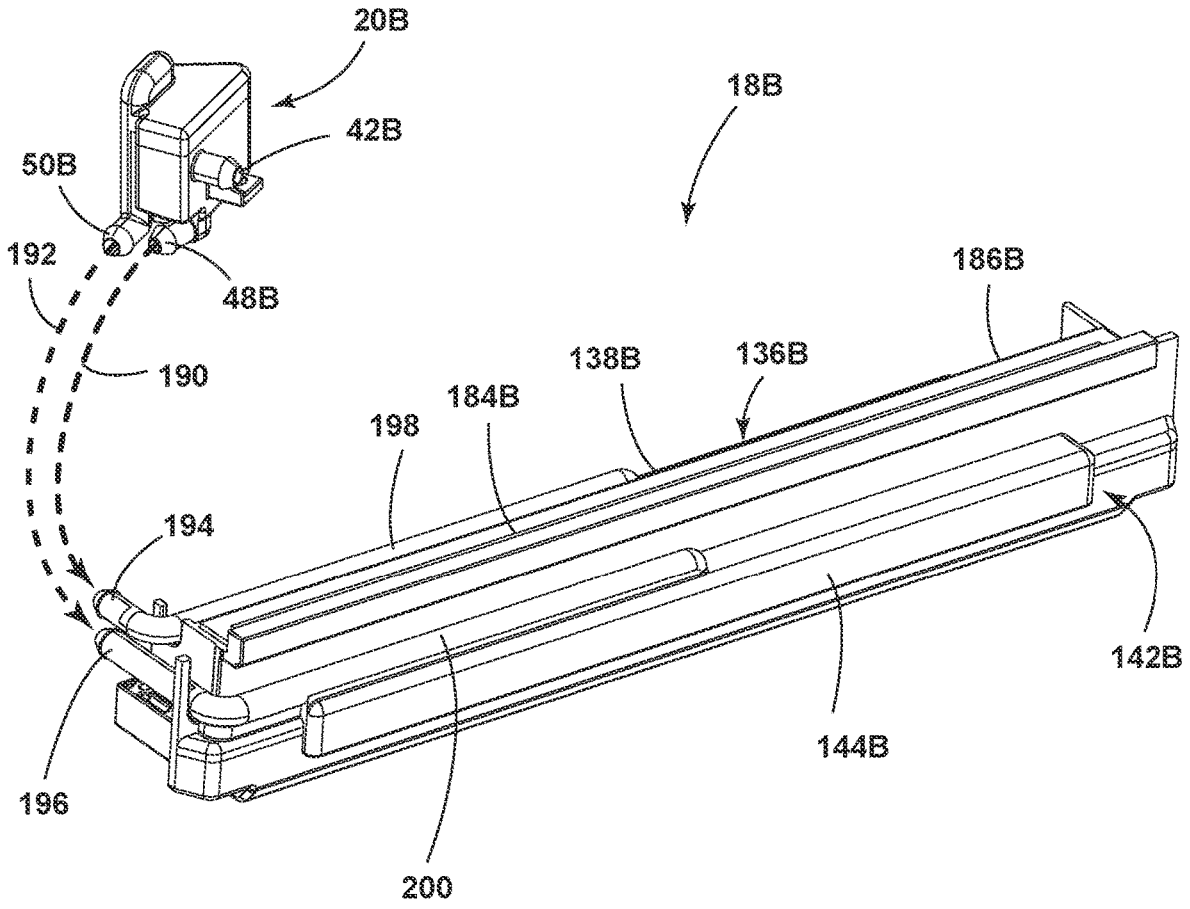
FIG. 15 is a front perspective view of the dual-phase distributor from FIG. 13.
Figure 16:
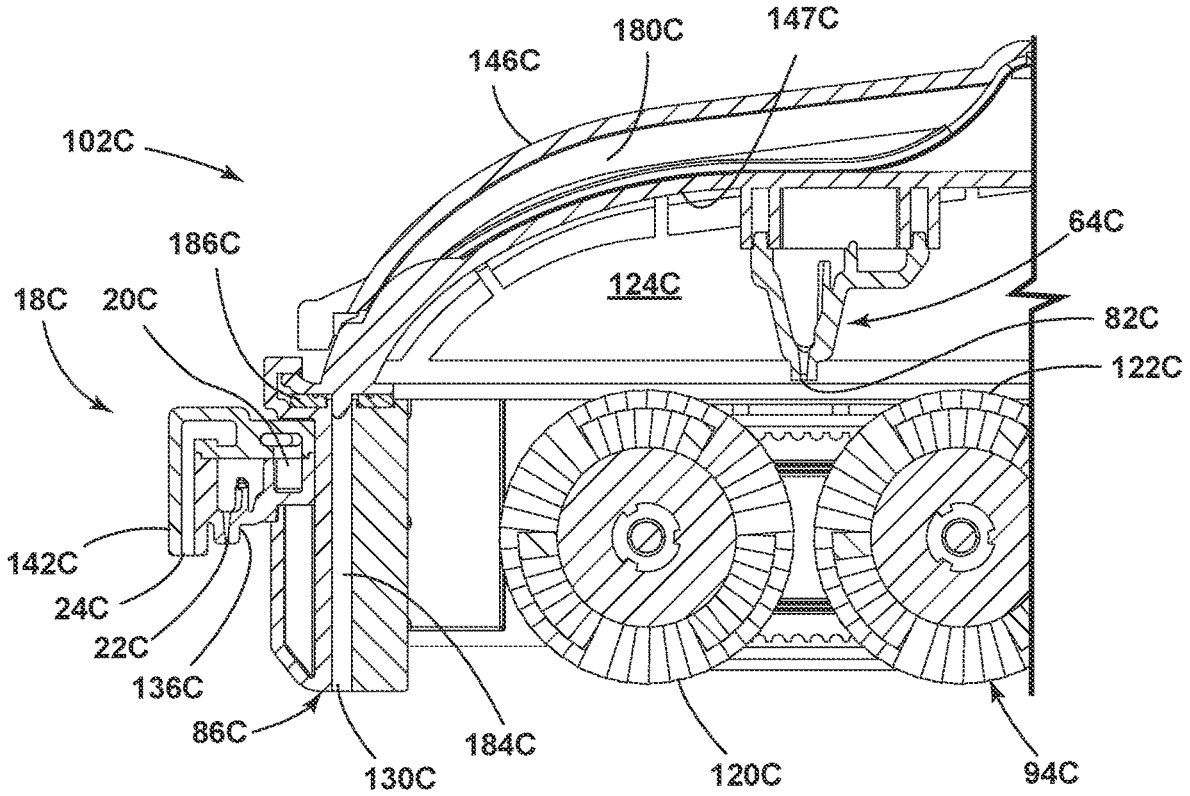
FIG. 16 is a cross-sectional view of a base for the extraction cleaner from FIG. 2, the base having a liquid distributor and a dual-phase fluid distributor according to a fourth aspect of the present disclosure.
Figure 17:
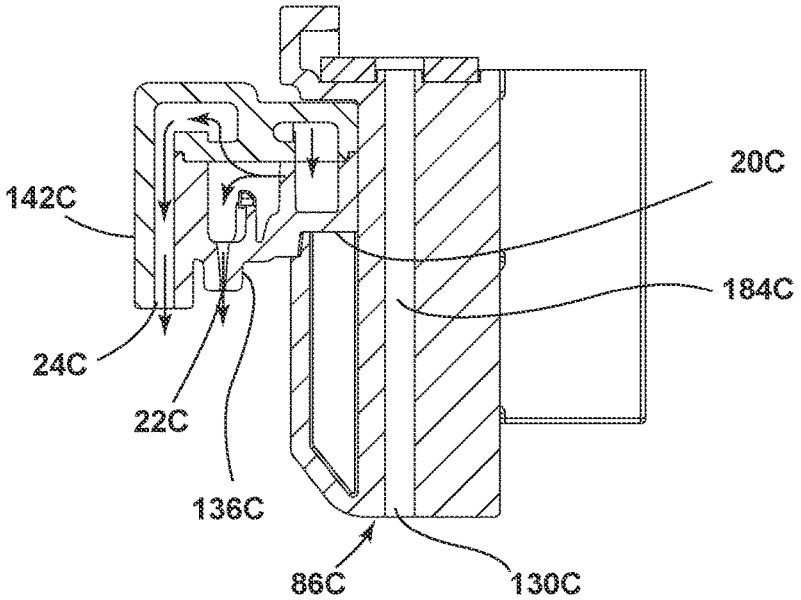
FIG. 17 is a sectional view through the dual-phase distributor from FIG. 16.
Figure 18:
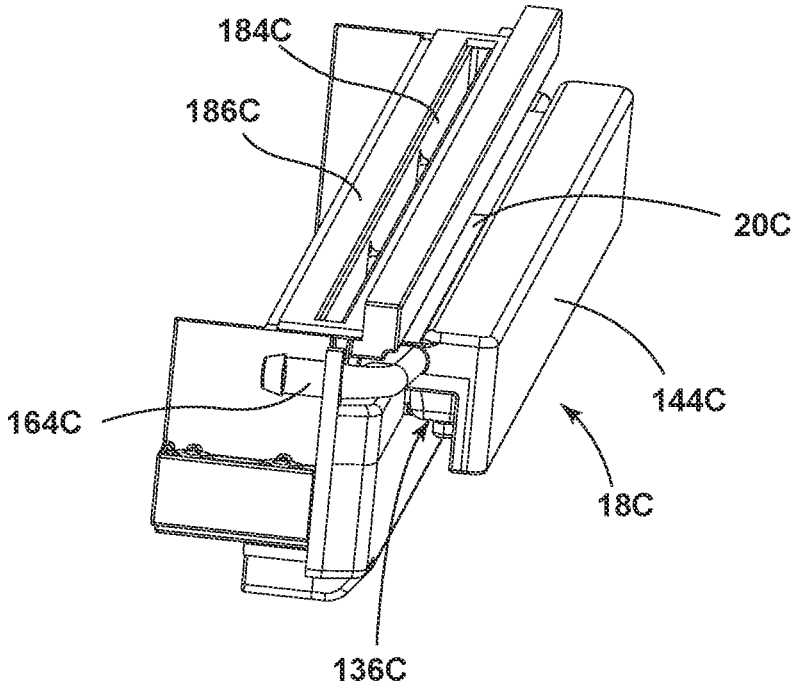
FIG. 18 is a front perspective view of the dual-phase distributor from FIG. 16.
Figure 19:
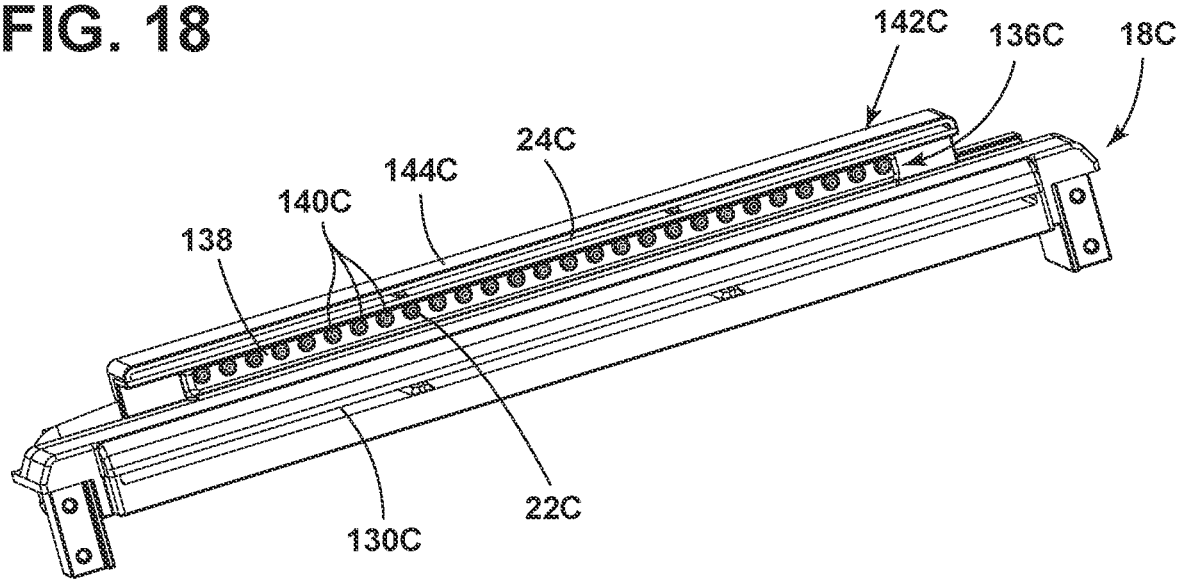
FIG. 19 is a bottom perspective view of the dual-phase distributor from FIG. 13.

FIGS. 13-15 show a dual-phase distributor 18B according to yet another aspect of the present disclosure. The dual-phase distributor 18B is substantially similar to the dual-phase distributor 18 of FIGS. 3-8, and like elements are referred to with the same reference numeral bearing a letter "B." The dual-phase distributor 18B differs by having the phase separator 20B remote from the heated liquid outlet 22B and the steam vapor outlet 24B, e.g. remote from the liquid dispenser 136B and steam dispenser 142B.

The phase separator 20B is fluidly coupled with the outlets 22B, 24B by conduits 190, 192, which may be flexible hoses or tubing routed through the base housing 112B. More specifically, the dual-phase distributor 18B can include a liquid discharge conduit 190 to supply the separated liquid phase from the liquid discharge port 48B to an inlet tube 194 of the heated liquid dispenser 136B and a vapor discharge conduit 192 to supply the separated vapor phase from the vapor discharge port 50B to an inlet tube 196 of the steam dispenser 142B.

The inlet tubes 194, 196 may be disposed at one end of the dispensers 136B, 142B. To supply heated liquid at or near the center of the heated liquid manifold 138B, a rigid inlet duct 198 runs from the heated liquid inlet tube 194 to a central portion of the manifold 138B. To supply steam vapor at or near the center of the steam manifold 144B, a rigid inlet duct 200 runs from the heated liquid inlet tube 196 to a central portion of the manifold 144B. As in previous embodiments, the liquid dispenser 136B may be behind the suction nozzle 86B and the steam vapor dispenser 142B may be forward of the suction nozzle 86B.

The phase separator 20B may be disposed at various locations in the base 102B.

In the illustrated embodiment, the phase separator 20B is rearward of the agitator 94B and the liquid dispenser 64B. The conduits 190, 192 may be routed along one lateral side of the base 102, past the agitator 94B, to couple with the inlet tubes 194, 196. In yet another embodiment, the phase separator 20B may be disposed in the upright assembly 100 (FIG. 2).

As in previous embodiments, the dual-phase distributor 18B may remain with the base 102B when the cover 146B is removed, or have a portion which is removable with the cover 146B. In the embodiment shown, the entire dual-phase distributor 18B remains the with base 102B when the cover 146B is removed. The cover 146B is removable from the lower nozzle portion 184B includes the suction nozzle inlet (not shown). The lower nozzle portion 184B is disposed between the heated liquid outlets 22B and the steam vapor outlet 24B.

FIGS. 16-19 show a dual-phase distributor 18C according to yet another aspect of the present disclosure. The dual-phase distributor 18C is substantially similar to the dual-phase distributor 18 of FIGS. 3-7, and like elements are referred to with the same reference numeral bearing a letter "C." The dual-phase distributor 18C differs in having both the heated liquid outlet 22C and the steam vapor outlet 24C disposed in front of the suction nozzle 86C. With the heated liquid outlet 22C positioned in front of the suction nozzle 86C, heated liquid outlets 22 deliver heated liquid onto the surface to be cleaned in front of the base 102.

The phase separator 20C is integrated with the dispensers 136C, 142C defining the heated liquid outlet 22C and the steam vapor outlet 24C, and is also be disposed in front of the suction nozzle 86C. Heated fluid enters the dual-phase distributor 18C by flowing around the suction nozzle 86C to reach the phase separator 20C. In yet another embodiment, the phase separator 20C may be remote from the heated liquid outlet 22B and the steam vapor outlet 24B as in the embodiment of FIGS. 12-14.

As in previous embodiments, the dual-phase distributor 18C may remain with the base 102C when the cover 146C is removed, or have a portion which is removable with the cover 146C. In the embodiment shown, the entire dual-phase distributor 18C remains the with base 102C when the cover 146C is removed. The cover 146C is removable from the lower nozzle portion 184C of the suction nozzle 86C which includes the suction nozzle inlet 130C. The lower nozzle portion 184C is disposed behind the heated liquid outlets 22C, the steam vapor outlet 24C, and the phase separator 20C.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Thus, the various features of the different embodiments may be mixed and matched in various vacuum cleaner configurations as desired to form new embodiments, whether or not the new embodiments are expressly described.

While primarily discussed herein in terms of an extraction cleaner, aspects of the surface cleaning apparatus and illumination systems disclosed herein are applicable to other types of surface cleaning apparatus, including any surface cleaning apparatus having a fluid delivery system for storing cleaning fluid (e.g. liquid) and delivering the cleaning fluid (e.g. liquid and/or steam) to the surface to be cleaned.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further aspects of the disclosure are provided by the subject matter of the following clauses:

A surface cleaning apparatus comprising a housing having a portion adapted for movement over a surface to be cleaned, a fluid supply container configured to store a supply of a cleaning fluid, a first supply path in fluid communication with the fluid supply container, the first supply path comprising a liquid dispenser having an unheated liquid outlet, a second supply path in fluid communication with the fluid supply container, the second supply path comprising a heater and a dual-phase distributor comprising a heated fluid inlet in fluid communication with the heater to receive heated fluid from the heater, a heated liquid outlet, and a steam vapor outlet.

A surface cleaning apparatus comprising a housing having a portion adapted for movement over a surface to be cleaned, a fluid supply container, a liquid dispenser having an unheated liquid outlet positioned to dispense unheated liquid directly onto the surface to be cleaned or onto a brushroll, a heater in fluid communication with the fluid supply container, and a dual-phase distributor comprising a heated fluid inlet in fluid communication with the heater to receive heated fluid from the heater, a heated liquid outlet positioned to dispense heated liquid onto the surface to be cleaned, and a steam vapor outlet positioned to dispense steam vapor toward the surface to be cleaned.

A surface cleaning apparatus comprising a housing adapted for movement over a surface to be cleaned, the housing comprising a base and a removable cover defining at least one of a suction nozzle and a brushroll chamber, and a fluid delivery system comprising a fluid supply container configured to store a supply of a cleaning fluid, a heater in fluid communication with the fluid supply container, and a dual-phase distributor comprising a heated fluid inlet in fluid communication with the heater to receive heated fluid from the heater, a heated liquid outlet positioned to dispense heated liquid onto the surface to be cleaned, and a steam vapor outlet positioned to dispense steam vapor toward the surface to be cleaned, wherein the steam vapor outlet is removable with the cover, optionally wherein the heated liquid outlet remains with the base when the cover is removed.

The handheld extraction cleaner according to the preceding clause comprising a liquid dispenser having an unheated liquid outlet, wherein the liquid dispenser is removable with the cover.

The handheld extraction cleaner according to any preceding clause wherein the cover defines both the suction nozzle and the brushroll cover.

The invention claimed is:

1. A surface cleaning apparatus comprising:

a housing having a portion adapted for movement over a surface to be cleaned; and a fluid delivery system comprising:

a fluid supply container configured to store a supply of a cleaning fluid;

a heater in fluid communication with the fluid supply container; and a heated fluid inlet in fluid communication with the heater to receive heated fluid from the heater;

a heated liquid outlet to dispense a liquid phase of the heated fluid to the surface to be cleaned as heated liquid; and a steam vapor outlet to dispense a vapor phase of the heated fluid as steam vapor;

one or more of:

an outlet diameter of the heated liquid outlet of approximately 0.5 mm;

the heated liquid outlet is disposed about 20 mm from an underside of the portion of the housing adapted for movement over a surface to be cleaned; and the steam vapor outlet is disposed about 9.75 mm from an underside of the portion of the housing adapted for movement over a surface to be cleaned; and a liquid delivery system comprising a liquid dispenser having an unheated liquid outlet, and comprising one or more of:

an outlet diameter of the unheated liquid outlet of approximately 0.8 to 1.0 mm; and the unheated liquid outlet is disposed about 20 to 25 mm from the underside of the portion of the housing adapted for movement over a surface to be cleaned.

2. The surface cleaning apparatus of claim 1, wherein the fluid delivery system comprises:

a supply path including the heater; and a pump configured to pressurize the supply path and control the delivery of heated fluid to the heated fluid inlet;

wherein:

the fluid delivery system is configured to dispense heated liquid at a flow rate of 41 to 72 ml/min from the heated liquid outlet; and the fluid delivery system is configured to dispense steam vapor at a flow rate of 10 to 18 ml/min from the steam vapor outlet.

3. The surface cleaning apparatus of claim 1, wherein:

the heater is configured to heat cleaning fluid to about 100° C.;

the heated liquid outlet is configured to dispense heated liquid at temperature of about 90 to 100° C.; and the steam vapor outlet is configured to dispense steam vapor at a temperature of about 90 to 100° C.

4. The surface cleaning apparatus of claim 1, wherein the heater generates heated fluid having a steam quality of 20 to 30%.

5. The surface cleaning apparatus of claim 1, wherein:

the fluid delivery system comprises:

a first supply path including the heater; and a first pump configured to pressurize the first supply path and control the delivery of heated fluid to the heated fluid inlet;

the liquid delivery system comprises:

a second supply path; and a second pump configured to pressurize the second supply path and control the delivery of cleaning fluid to the unheated liquid outlet;

the fluid delivery system is configured to dispense heated liquid at a flow rate of 41 to 72 ml/min from the heated liquid outlet;

the fluid delivery system is configured to dispense steam vapor at a flow rate of 10 to 18 ml/min from the steam vapor outlet; and the liquid delivery system is configured to dispense cleaning fluid at a flow rate of 1600 to 2100 ml/min from the unheated liquid outlet.

6. The surface cleaning apparatus of claim 1, wherein the liquid dispenser is in fluid communication with the fluid supply container.

7. The surface cleaning apparatus of claim 6, comprising a manifold splitter in fluid communication with an outlet of the fluid supply container, the manifold splitter comprising a first outlet in fluid communication with a steam supply path including the heater and the heated fluid inlet and second outlet in fluid communication with a liquid supply path including the liquid dispenser.

8. The surface cleaning apparatus of claim 7, wherein the steam supply path comprises a first pump and the liquid supply path comprises a second pump.

9. The surface cleaning apparatus of claim 1, comprising at least one brushroll, and the heated liquid outlet is positioned to dispense the cleaning fluid in front of the at least one brushroll.

10. The surface cleaning apparatus of claim 9, wherein the steam vapor outlet is positioned forwardly of the at least one brushroll and forwardly of the heated liquid outlet.

11. The surface cleaning apparatus of claim 1, wherein the heated liquid outlet is positioned to dispense heated liquid directly onto the surface to be cleaned, and the steam vapor outlet is positioned to dispense steam vapor toward the surface to be cleaned.

12. The surface cleaning apparatus of claim 1, comprising:

a heated liquid dispenser comprising the heated liquid outlet; and a steam dispenser comprising the steam vapor outlet, wherein the steam dispenser is positioned on an exterior of the housing and the heated liquid dispenser is located within an interior of the housing.

13. The surface cleaning apparatus of claim 1, comprising a suction nozzle, wherein the steam vapor outlet is positioned forwardly of the suction nozzle and the heated liquid outlet is positioned rearwardly of the suction nozzle.

14. The surface cleaning apparatus of claim 1, comprising a suction nozzle, wherein the steam vapor outlet is positioned forwardly of the suction nozzle and the heated liquid outlet is positioned forwardly of the suction nozzle.

15. The surface cleaning apparatus of claim 1, comprising a suction nozzle and a vapor discharge conduit to supply the vapor phase to the steam vapor outlet, wherein the vapor discharge conduit ports the vapor phase around the suction nozzle.

16. The surface cleaning apparatus of claim 1, comprising a fluid recovery system comprising a suction nozzle, a recovery container, and a suction source, wherein at least the steam vapor outlet is located on an exterior of the suction nozzle.

17. The surface cleaning apparatus of claim 1, wherein the surface cleaning apparatus is an upright extraction cleaner and includes a base adapted for movement across a surface to be cleaned and an upright assembly that is pivotally connected to the base for directing the base across the surface to be cleaned.

18. The surface cleaning apparatus of claim 1, wherein:

the fluid delivery system comprises a first supply path that passes through the heater; and the liquid delivery system comprises a second supply path that bypasses the heater.

19. The surface cleaning apparatus of claim 18, wherein the heater is configured to at least one of:

heat cleaning fluid to about 100° C.; and generate heated fluid having a steam quality of 20 to 30%.

* * * * *